US010060165B2

(12) United States Patent
Yamaguchi et al.

(10) Patent No.: US 10,060,165 B2
(45) Date of Patent: Aug. 28, 2018

(54) DOOR LOCK DEVICE

(71) Applicant: AISIN SEIKI KABUSHIKI KAISHA, Kariya-shi (JP)

(72) Inventors: Atsushi Yamaguchi, Anjo (JP); Takeshi Tada, Okazaki (JP); Yasuhiko Sono, Hekinan (JP); Masashi Taniyama, Toyohashi (JP); Yusuke Kojima, Okazaki (JP); Atsushi Katsurayama, Anjo (JP); Takashi Nishio, Kariya (JP); Kazunori Kojima, Aichi-gun (JP); Masanari Iwata, Ichinomiya (JP); Yusuke Yamada, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 742 days.

(21) Appl. No.: 14/417,715

(22) PCT Filed: Jul. 24, 2013

(86) PCT No.: PCT/JP2013/070035
§ 371 (c)(1),
(2) Date: Jan. 27, 2015

(87) PCT Pub. No.: WO2014/021162
PCT Pub. Date: Feb. 6, 2014

(65) Prior Publication Data

US 2015/0191945 A1 Jul. 9, 2015

(30) Foreign Application Priority Data

Jul. 31, 2012 (JP) ..... 2012-170590
Jul. 31, 2012 (JP) ..... 2012-170591

(51) Int. Cl.
*E05C 3/06* (2006.01)
*E05B 85/20* (2014.01)
(Continued)

(52) U.S. Cl.
CPC ..... *E05B 85/20* (2013.01); *E05B 79/08* (2013.01); *E05B 81/90* (2013.01); *E05B 83/36* (2013.01);
(Continued)

(58) Field of Classification Search
CPC ..... Y10S 292/55; Y10S 292/73; E05B 81/90
(Continued)

(56) References Cited

U.S. PATENT DOCUMENTS 4,756,563 A * 7/1988 Garwood ..... E05B 85/243 292/216
5,520,426 A * 5/1996 Arabia, Jr. ..... E05B 77/38 292/216
(Continued)

FOREIGN PATENT DOCUMENTS

JP 59-12376 U 1/1984
JP 02-45398 Y2 11/1990
(Continued)

OTHER PUBLICATIONS

Office Action (Reason for Refusal) dated Mar. 15, 2017, by the Japanese Patent Office in corresponding Japanese Patent Application No. 2016-039797, and an English translation of the Office Action. (8 pgs).
(Continued)

*Primary Examiner* — Carlos Lugo
(74) *Attorney, Agent, or Firm* — Buchanan Ingersoll & Rooney PC

(57) ABSTRACT

A door lock device has a high degree of freedom in the disposition of an open link for switching between a locked
(Continued)

state and an unlocked state and has low operational resistance when being put into the locked state. When there is a malfunction in which the open link is jammed by the dust and therefore does not move from a lock waiting position to an unlock waiting position even when an unlock action is performed, when an outside handle interlock lever is turned, a sliding-contact tilt guide provided on a support body slides and makes sliding-contact with the open link and forcibly tilts the open link, and as a result, it becomes unnecessary to increase an energizing force of a torsion coil spring as a precaution against such malfunction. This makes it possible to reduce the operational resistance when the door lock device is put into the locked state.

12 Claims, 36 Drawing Sheets

(51) Int. Cl.

| | |
|---|---|
| ***E05B 79/08*** | (2014.01) |
| ***E05B 81/90*** | (2014.01) |
| ***E05B 85/02*** | (2014.01) |
| ***E05B 83/36*** | (2014.01) |
| *E05C 3/16* | (2006.01) |

(52) U.S. Cl.
CPC ..... *E05B 85/02* (2013.01); *Y10S 292/55* (2013.01); *Y10S 292/73* (2013.01); *Y10T 292/1076* (2015.04)

(58) Field of Classification Search
USPC ..... 292/201, 216
See application file for complete search history.

(56) References Cited

U.S. PATENT DOCUMENTS

| | | | | |
|---|---|---|---|---|
| 6,024,389 | A * | 2/2000 | Arabia, Jr. | E05B 85/243 292/216 |
| 7,090,264 | B2 * | 8/2006 | Dzurko | E05B 85/243 292/201 |
| 7,413,225 | B2 * | 8/2008 | Spurr | E05B 17/007 292/201 |
| 7,798,539 | B2 * | 9/2010 | Hayakawa | E05B 81/06 292/201 |
| 7,810,853 | B2 * | 10/2010 | Margheritti | E05B 81/25 292/216 |
| 7,845,692 | B2 * | 12/2010 | Inan | E05B 77/38 292/216 |
| 8,011,700 | B2 * | 9/2011 | Ishiguro | E05B 81/04 292/201 |
| 8,056,944 | B2 * | 11/2011 | Jankowski | E05B 77/06 292/201 |
| 8,276,949 | B2 * | 10/2012 | Akizuki | E05B 77/06 292/201 |
| 8,740,264 | B2 * | 6/2014 | Akizuki | E05B 77/265 292/201 |
| 8,814,226 | B2 * | 8/2014 | Akizuki | E05B 77/30 292/196 |
| 9,376,843 | B2 * | 6/2016 | Akizuki | E05B 15/04 |
| 9,617,760 | B2 * | 4/2017 | Dragon | E05B 77/36 |
| 2004/0239124 | A1 * | 12/2004 | Larsen | E05B 81/14 292/201 |
| 2009/0212577 | A1 * | 8/2009 | Fukunaga | E05B 81/06 292/216 |
| 2011/0254287 | A1 | 10/2011 | Akizuki et al. | |
| 2014/0217751 | A1 * | 8/2014 | Lujan | E05B 77/38 292/216 |

FOREIGN PATENT DOCUMENTS

| | | | |
|---|---|---|---|
| JP | 2552209 | B2 | 11/1996 |
| JP | H09-281587 | A | 10/1997 |
| JP | H10-274222 | A | 10/1998 |
| JP | 2000-52769 | A | 2/2000 |
| JP | 2007-138453 | A | 6/2007 |
| JP | 2011-26779 | A | 2/2011 |
| JP | 2011-220094 | A | 11/2011 |
| JP | 2012-092631 | A | 5/2012 |
| WO | 2012/056869 | A1 | 5/2012 |

OTHER PUBLICATIONS

International Search Report (PCT/ISA/210) dated Oct. 15, 2013, by the Japanese Patent Office as the International Searching Authority for International Application No. PCT/JP2013/070035.
Written Opinion (PCT/ISA/237) dated Oct. 15, 2013, by the Japanese Patent Office as the International Searching Authority for International Application No. PCT/JP2013/070035.
Office Action (Notice of Reasons for Rejection) dated Jan. 5, 2016, by the Japanese Patent Office in corresponding Japanese Patent Application No. 2012-170590, and an English Translation of the Office Action. (5 pages).

* cited by examiner

DOOR LOCK DEVICE

TECHNICAL FIELD

The present invention relates to a door lock device which includes a latch mechanism latching a door of a vehicle and which is switchable between an unlocked state where the latching by the latch mechanism is releasable by an operation of a door handle and a locked state where the latching by the latch mechanism is unreleasable.

BACKGROUND ART

A known door lock device illustrated in FIG. 34 is provided with an open link 2 which is extended in an up/down direction and of which a lower end portion is tiltably connected to a distal end portion of a handle interlock lever 1. In addition, the open link 2 is connected to an active lever 3 by means of a pin 2A and an elongated hole 3A. The open link 2 receives, via the active lever 3, an operation force relative to a lock switch operation portion provided at a vehicle, and moves between an unlock position where being tilted towards one side and a lock position where being tilted towards another side. As a door handle is operated, the handle interlock lever 1 rotates and the open link 2 moves upward. At this time, if the open link 2 is positioned at the unlock position, the open link 2 pushes up a lift lever 4, which is provided at the latch mechanism, from a lower side and accordingly the latching of a door is released. On the other hand, if the open link 2 is positioned at the lock position, the open link 2 passes beyond a lateral side of the lift lever 4 even though the handle interlock lever 1 rotates and the open link 2 moves upward. And thus the latching of the door by the latch mechanism is maintained (for example, see Patent document 1).

DOCUMENT OF PRIOR ART

Patent Document

Patent document 1: JP2007-138453A (FIG. 8, FIG. 9, and paragraphs [0063] and [0064])

OVERVIEW OF INVENTION

Problem to be Solved by Invention

According to a structure of the above-described known door lock device, the open link 2 connected to the handle interlock lever 1 is further connected to the active lever 3 by means of the pin 2A and the elongated hole 3A, and thus there is a problem that a degree of freedom in disposition of the open link 2 is low. On the other hand, a door lock device is suggested at which a motive power by a motor or by a human hand is used in a case where the open link 2 is moved from the unlock position to the lock position, and a spring force is used in a case where the open link 2 is moved from the lock position to the unlock position. However, in such a structure, the spring force needs to be large so that the open link 2 returns from the lock position to the unlock position reliably even in a case where there is a malfunction in which a connection portion of the handle interlock lever 1 and the open link 2 is jammed by dust. Accordingly, at a normal time, there is a concern that a large load is applied to an operator who performs a lock operation or to a motor driving the active lever 3 in response to the operation.

The present invention is made in light of the above-described circumstance, and a purpose of the present invention is to provide a door lock device at which a degree of freedom in disposition of an open link for switching between a locked state and an unlocked state is high, and operational resistance when establishing the locked state is small.

Means for Solving Problem

A door lock device which is made to achieve the above-described purpose, includes a latch mechanism adapted to latch a door of a vehicle in a closed state, a handle interlock lever normally positioned at an original position and adapted to rotate to an operation position upon receiving an operation force relative to a door handle of the vehicle, an open link tiltably connected to a position in the handle interlock lever which is away from a rotational center of the handle interlock lever, the open link being switchable between an unlocked state in which the open link is positioned at an unlock position at which the open link pushes a latch release portion included in the latch mechanism and unlatches the door when the handle interlock lever rotates to the operation position, and a locked state in which the open link is positioned at a lock position at which the open link passes a lateral side of the latch release portion and does not unlatch the door when the handle interlock lever rotates to the operation position, a tilt biasing spring biasing the open link towards the unlock position, a link waiting position determination portion positioning the open link at a lock waiting position when the handle interlock lever is arranged at the original position in the locked state, the link waiting position determination portion allowing the open link to be tilted towards the unlock position by a biasing of the tilt biasing spring in the middle of movement of the handle interlock lever from the original position to the operation position, a link operation position determination portion making contact with the open link in the middle of the movement of the handle interlock lever from the original position to the operation position in the locked state, preventing the open link from tilting to the unlock position, and keeping the open link at the lock position, and a sliding-contact tilt guide making sliding-contact with the open link and causing the open link to tilt towards the lock position at a time of malfunction when the handle interlock lever rotates from the original position to the operation position in a state where the open link is maintained at the lock waiting position.

The door lock device includes a lateral inclination restriction protruding portion applied to one side surface or both side surfaces of the open link in a direction of a tilt axis of the open link and restricting the open link from inclining laterally.

The door lock device includes a tilt connection hole formed in a penetrating manner at one of the handle interlock lever and the open link at the connecting portion of the handle interlock lever and the open link, a tilt connection protruding piece protruding from the other of the handle interlock lever and the open link at the connecting portion of the handle interlock lever and the open link, and including a distal end wide width portion at a distal end, the tilt connection protruding piece being inserted into the tilt connection hole in a state where the open link is in a laterally-inclined posture inclined towards one side, the tilt connection protruding piece being prevented from coming off by changing the open link to a normal posture, the tilt connection protruding piece connecting the open link to the handle interlock lever in a manner that the open link is tiltable, and the lateral inclination restriction protruding portion arranged at a position at which the lateral inclination restriction protruding portion restricts the open link from laterally inclining to the one side.

The door lock device includes a sliding-contact protruding piece including a shape of a protruding piece projecting from the open link in the direction of the tilt axis thereof, wherein the link operation position determination portion and the sliding-contact tilt guide are sliding-contactable with the sliding-contact protruding piece.

The door lock device includes a support body adapted to be fixed to the door, the latch mechanism being assembled on the support body, the handle interlock lever rotatably supported at the support body, and the sliding-contact tilt guide formed at the support body.

The door lock device includes the support body on which the latch mechanism being assembled, the support body being made of resin, a component support wall provided at the support body and adapted to be arranged to oppose a door end portion wall which is at a side opposite to a rotational center of the door, a lever rotation support shaft portion protrudingly formed at the component support wall and being inserted into a through hole included in the handle interlock lever, the lever rotation support shaft portion supporting the handle interlock lever in a rotatable manner, and a support shaft portion reinforcing rib formed at a peripheral portion of the lever rotation support shaft portion of the component support wall or at a peripheral portion of a reverse side of the lever rotation support shaft portion of the component support wall.

The door lock device includes the support shaft portion reinforcing rib extended radially centered on the lever rotation support shaft portion.

The door lock device includes a surrounding wall protrudingly formed at the component support wall and surrounding, from a lateral side, a circumferential part of an end portion of the lever rotation support shaft portion at a side of the component support wall, a latch-holding torsion coil spring including a coil portion which is inserted at the end portion of the lever rotation support shaft portion at the side of the component support wall and is accommodated between the surrounding wall and the lever rotation support shaft portion, the latch-holding torsion coil spring engaging with a part of the latch mechanism and biasing the latch mechanism towards a side at which the latch mechanism latches the door, and the support shaft portion reinforcing rib formed at a protruding portion support wall of the support body, the protruding portion support wall connecting the lever rotation support shaft portion and the surrounding wall with each other.

The door lock device includes a sloped outer circumferential surface formed at the lever rotation support shaft portion and including a draft angle, and a coil contact protrusion protrudingly formed at a portion of a circumferential direction of the sloped outer circumferential surface, the portion being in contact with the coil portion, the coil contact protrusion including a ridge line which is parallel to an axial direction of the lever rotation support shaft portion.

The door lock device includes a component support auxiliary wall provided at the support body and opposing the component support wall, the lever rotation support shaft portion where a distal end portion of a support protruding portion protrudingly formed at the component support wall is fitted into a support cylinder portion protrudingly formed at the component support auxiliary wall, an annular protrusion protrudingly formed at the component support auxiliary wall and surrounding the entire support cylinder portion from a lateral side, and the handle interlock lever including the through hole into which the support cylinder portion is inserted, an opening edge of the through hole being applied to the annular protrusion.

The door lock device includes an auxiliary wall reinforcing rib protrudingly formed at the component support auxiliary wall to be lower than the annular protrusion and extended radially from the annular protrusion.

The door lock device includes a component support auxiliary wall provided at the support body and opposing the component support wall, the lever rotation support shaft portion where a distal end portion of a support protruding portion protrudingly formed at the component support wall is fitted into a support cylinder portion protrudingly formed at the component support auxiliary wall, and a distal end sloped surface formed at a distal end of the support cylinder portion and obliquely intersecting a central axis of the support cylinder portion.

Effects of the Invention

At the door lock device, the open link is pushed by a biasing force of the tilt biasing spring against the link waiting position determination portion or the link operation position determination portion, and is positioned thereat, and accordingly a degree of freedom in disposition of the open link is higher compared to a known case where an open link is connected to another component by means of a pin and an elongated hole. In addition, at a malfunction in which the open link does not move from the lock waiting position due to jamming by inclusion of dust or the like, the sliding-contact tilt guide makes sliding-contact with the open link and forcibly causes the open link to tilt to promote elimination of the dust or the like when the handle interlock lever is rotated, thereby eliminating the malfunction. Therefore, there is no need to increase the biasing force of the tilt biasing spring as a precaution against the above-described malfunction. Consequently, an operational resistance when the door lock device is put into the locked state can be reduced.

At the door lock device, of claim 2, the lateral inclination restriction protruding portion restricts the open link from inclining laterally, and an operational resistance of the open link is prevented from increasing. This can also reduce the biasing force of the tilt biasing spring and reduce the operational resistance when the door lock device is put into the locked state.

At the door lock device, of claim 3, the open link is laterally inclined towards the one side and then the tilt connection protruding piece is inserted into the tilt connection hole. Then, by changing the open link to the normal posture, the tilt connection protruding piece is prevented from coming off the tilt connection hole, and the handle interlock lever and the open link can be tiltably connected to each other. After the connection, the open link is prevented from inclining laterally towards the one side by the lateral inclination restriction protruding portion, and accordingly the tilt connection protruding piece is reliably prevented from coming off the tilt connection hole.

At the door lock device, the sliding-contact protruding piece of the open link is used for dual purposes as a portion to which the link operation position determination portion contacts and also as a portion at which the sliding-contact tilt guide makes sliding-contact. Consequently, the open link includes a simple structure.

According to the door lock device, the latch mechanism and the handle interlock lever are assembled to the support body to form an assembly, and accordingly an assembling work of the door lock device can be performed easily.

At the door lock device, the support shaft portion reinforcing rib is protrudingly formed at the component support wall at the peripheral portion of the lever rotation support shaft portion supporting the handle interlock lever in the rotatable manner, or at the component support wall at the peripheral portion of the reverse side of the lever rotation support shaft portion. Consequently, strength of a rising portion of the lever rotation support shaft portion at the component support wall is increased, and thus durability against load applied to the lever rotation support shaft portion improves. Accordingly, the entire lever rotation support shaft portion can be prevented from inclining, and a rotation resistance of the handle interlock lever is prevented from increasing and abnormal noises can be prevented from occurring.

The support shaft portion reinforcing rib may be extended in a horizontal direction or may be extended in an up/down direction. In addition, in a case where the support shaft portion reinforcing rib includes a grid configuration or in a case where the support shaft portion reinforcing rib includes a radial configuration centered on the lever rotation support shaft portion, durability against the load can be enhanced in both up/down direction and horizontal direction.

At the door lock device, the lever rotation support shaft portion is used for supporting the latch-holding torsion coil spring and for supporting the handle interlock lever, and thus the door lock device includes a compact structure compared to a case where they are supported separately from each other. In addition, the coil portion of the latch-holding torsion coil spring is surrounded from an outer side by the surrounding wall formed protrudingly at the component support wall, and thus the coil portion is supported in a stabilized manner. In addition, the support shaft portion reinforcing rib is formed at the protruding portion support wall of the component support body which connects the lever rotation support shaft portion and the surrounding wall with each other, and thus a durability-and-strength of the protruding portion support wall against an impact force from a vehicle lateral surface can be increased.

At the door lock device, the coil contact protrusion including the ridge line that is parallel to the axial direction of the lever rotation support shaft portion is provided at the contact portion with the coil portion at the sloped outer circumferential surface of the lever rotation support shaft portion, and the sloped outer circumferential surface including the draft angle. Consequently, it is prevented that the coil portion is dislocated in the axial direction of the lever rotation support shaft portion due to the draft angle of the sloped outer circumferential surface.

At the door lock device, the lever rotation support shaft portion is in a state of the both end supported beam structure between the component support wall and the component support auxiliary wall, and thus a bearing strength of the handle interlock lever improves. In addition thereto, at the door lock device, the annular protrusion surrounding the entire support cylinder portion from the lateral side is provided at the component support auxiliary wall, and the opening edge of the through hole of the handle interlock lever is applied to the annular protrusion. Consequently, even in a case where burrs remain at an edge portion of the through hole, the burrs are received in an annular gap between the annular protrusion and the support cylinder portion, and the handle interlock lever rotates smoothly. In addition, at the door lock device, the support cylinder portion is cut obliquely to include the distal end sloped surface, and thus a distal end portion of the support protruding portion can be inserted into the support cylinder portion gradually, thereby facilitating the insertion operation.

At the component support auxiliary wall of the door lock device, the auxiliary wall reinforcing rib extended radially from the annular protrusion is provided. Consequently, strength of the entire the component support auxiliary wall is increased and durability is enhanced. This can also prevent the rotation resistance of the handle interlock lever from increasing and prevent the abnormal noises from occurring.

MODE FOR CARRYING OUT THE INVENTION

First Embodiment

Figure 1:
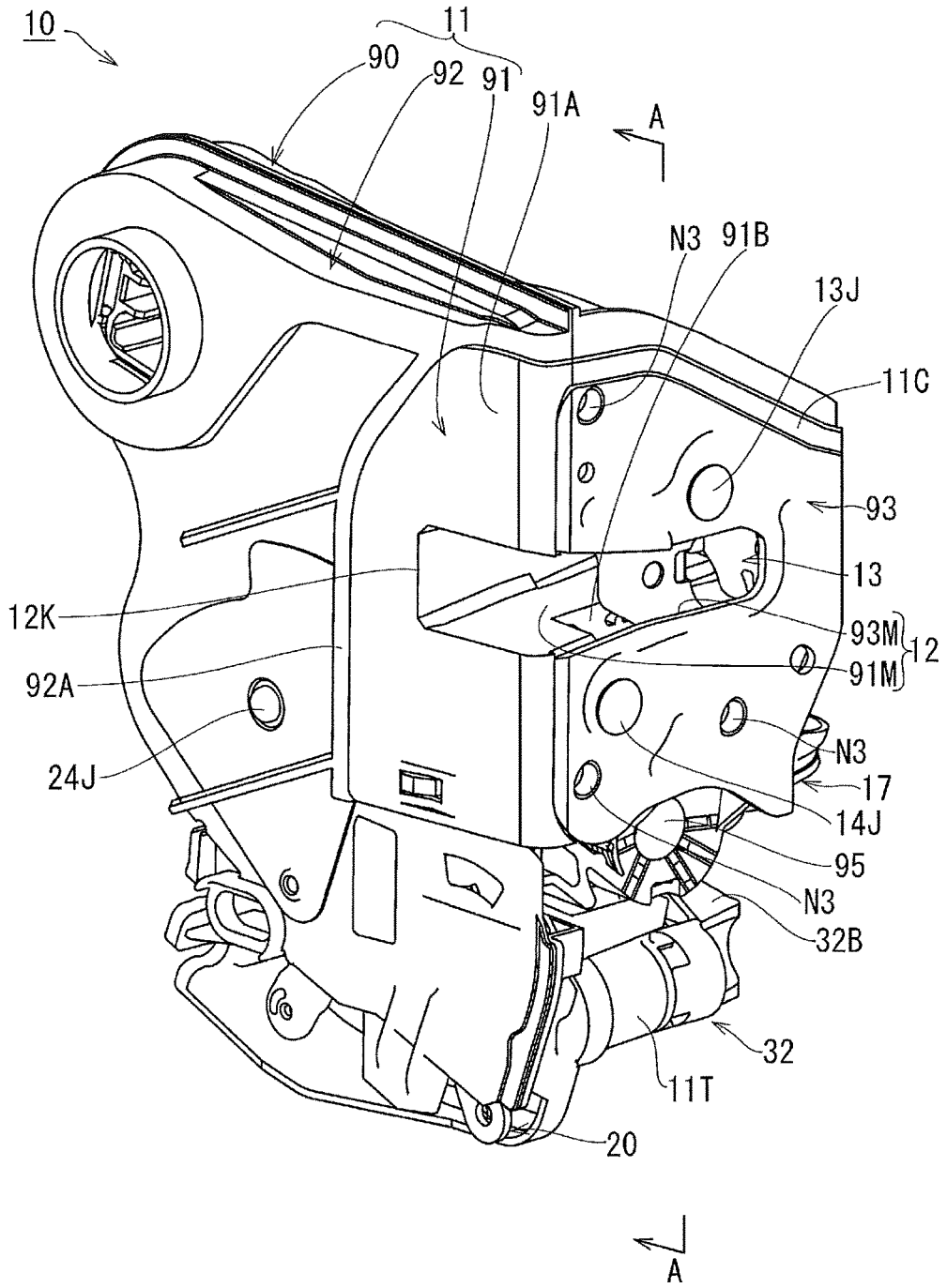
FIG. 1 Perspective view of a door lock device according to a first embodiment of the present invention FIG. 2 Plan view of a main body, and first and second covers FIG. 3 Perspective view of a vehicle outer side of a door of a vehicle FIG. 4 Perspective view of a vehicle inner side of the door of the vehicle FIG. 5 Side view of a latch and a ratchet in an unlatched state FIG. 6 Side view of the latch and the ratchet in a latched state FIG. 7 Perspective view of a state in which components are attached to a first component support wall FIG. 8 Perspective view of a state in which the components are attached to a second component support wall FIG. 9 Enlarged perspective view of the state in which the components are attached to the second component support wall FIG. 10A Side view of a lift lever, an open link and the like before a door handle operation in a locked state (a lock waiting position)
Figure 2:
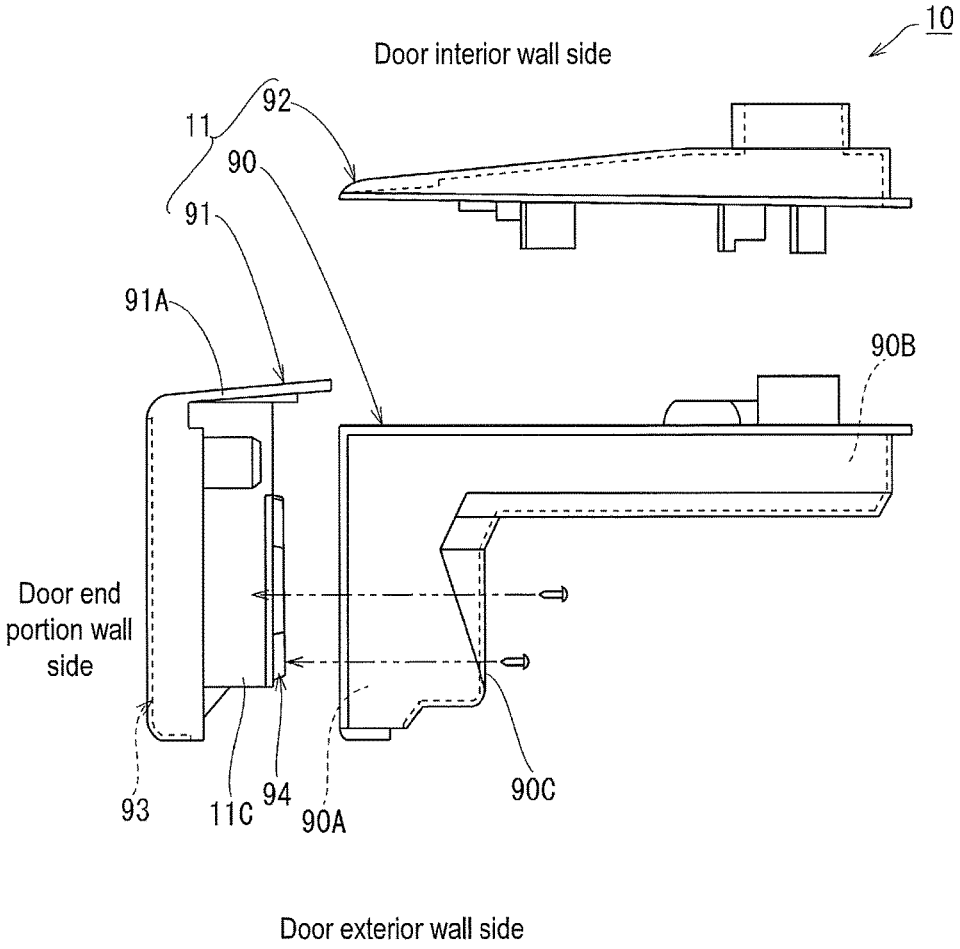

A first embodiment according to the present invention will be described below on the basis of FIG. 1 to FIG. 26. As illustrated in FIG. 1, a door lock device 10 of the present embodiment includes a support body 11 made of resin and plural components assembled on the support body 11. The support body 11 is constituted by, for example, a main body 90 made of resin, and first and second covers 91 and 92 each made of resin. When the main body 90 is seen from above as illustrated in FIG. 2, the entire main body 90 is formed in a shape of a letter L and includes first and second component accommodation portions 90A and 90B at both side surfaces arranged side by side with each other in a manner that an outer side corner portion is interposed therebetween. The first cover 91 is assembled on the main body 90 so as to cover the first component accommodation portion 90A which is arranged at a short side of the shape of the letter L of the main body 90 while the second cover 92 is assembled on the main body 90 so as to cover the second component accommodation portion 90B which is arranged at a long side of the shape of the letter L of the main body 90. Thus, the entire support body 11 is formed in a shape of a letter L similarly to the main body 90.

Figure 8:
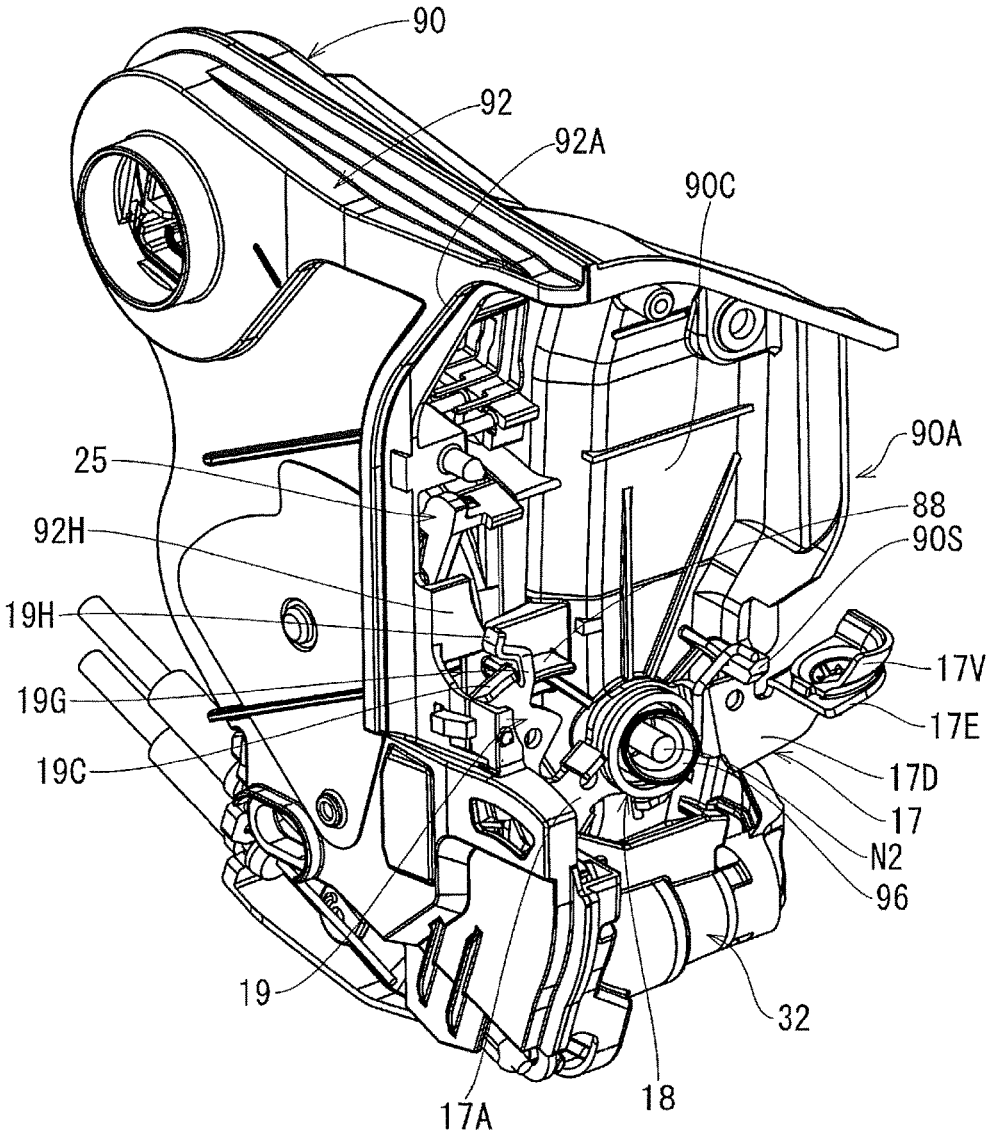

The first cover 91 is provided with a first component support wall 11C supporting components which are accommodated in the first component accommodation portions 90A, and a side protruding wall 91A protrudes from one side edge portion of the first component support wall 11C towards the second cover 92. In addition, the second cover 92 is formed with a recessed curve edge portion 92A in a manner that the recessed curve edge portion 92A corresponds to the side protruding wall 91A as illustrated in FIG. 8. Then, as illustrated in FIG. 1, an edge portion of the side protruding wall 91A is overlapped with the recessed curve edge portion 92A from an outer side. In the present embodiment, the first component support wall 11C corresponds to "a component support wall" according to the present invention, and a second component support wall 90C of the main body 90 which is at an inner deep side of the first component accommodation portions 90A opposing the first component support wall 11C corresponds to "a component support auxiliary wall" of the present invention.

Figure 3:
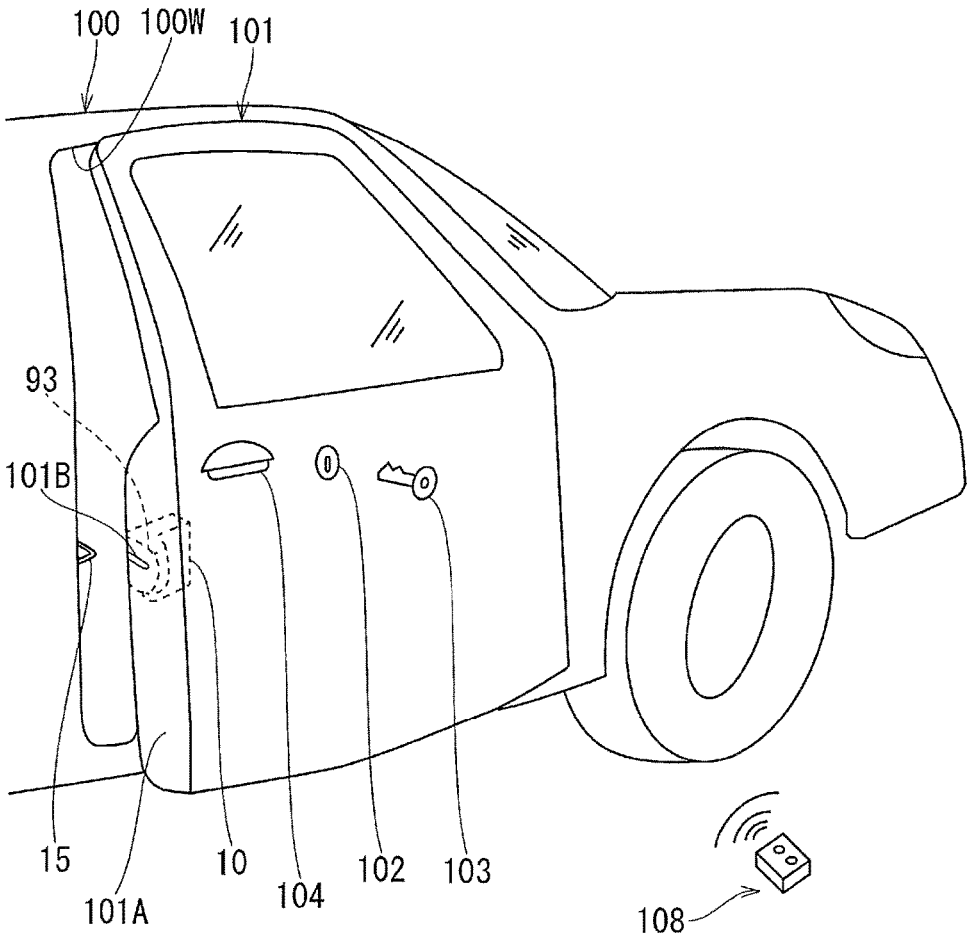
Figure 5:
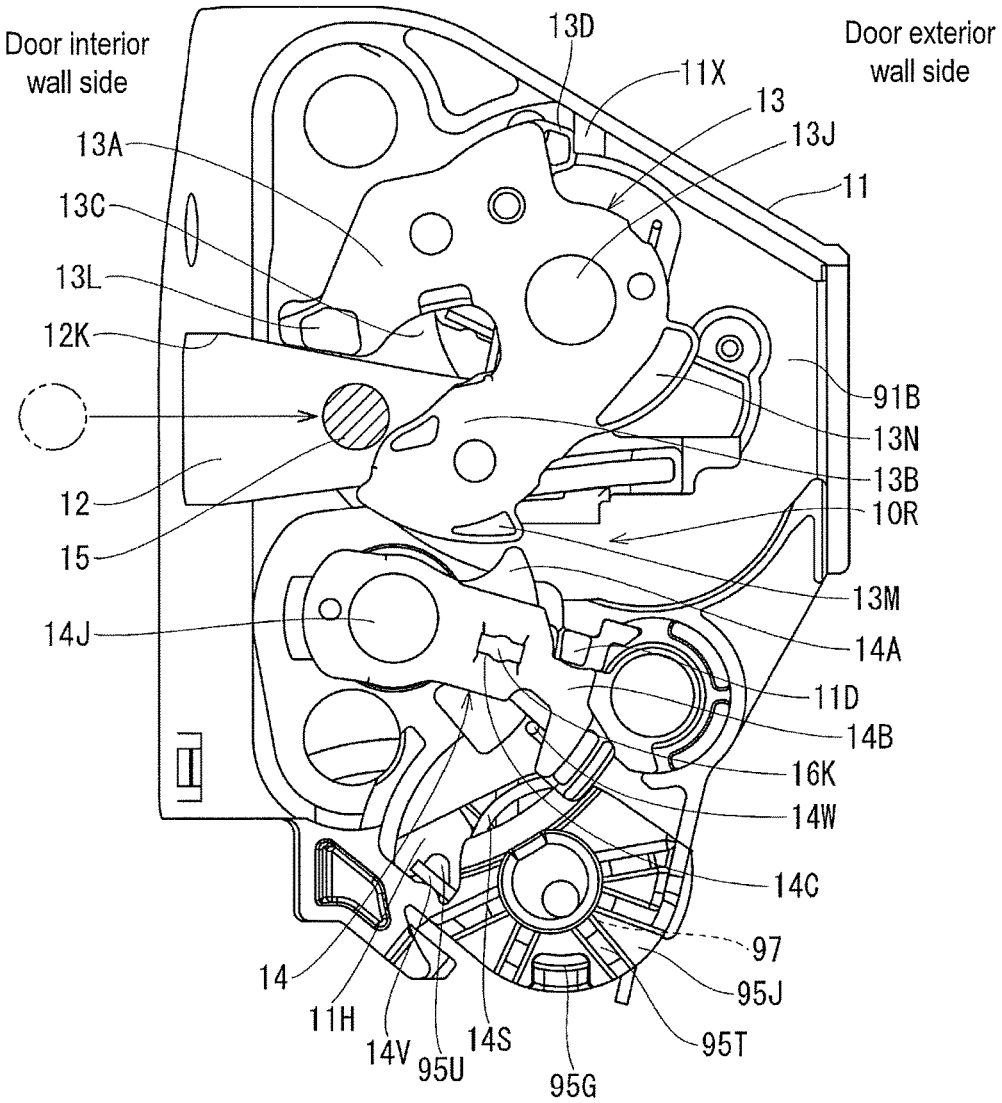

As illustrated in FIG. 2, an outer surface reinforcing board 93 made from sheet metal is applied to an outer surface of the first component support wall 11C while an inner surface reinforcing board 94 made from sheet metal is applied to an inner surface of the first cover 91, and the outer surface reinforcing board 93 and the inner surface reinforcing board 94 are fixed by a latch support shaft 13J and a ratchet support shaft 14J which penetrate the first component support wall 11C (see FIG. 5). Then, for example, as illustrated in FIG. 3, the outer surface reinforcing board 93 is applied, from an inner side, to an end portion wall 101A of a pivot-type door 101 arranged at a right side of a vehicle 100, the end portion wall 101A being at a side that is opposite to a rotational center of the door 101. And plural bolts which are not illustrated and which penetrate the end portion wall 101A are tightened at plural screw holes N3 (see FIG. 1) of the outer surface reinforcing board 93, and thus the support body 11 is fixed to the door 101.

Figure 13:
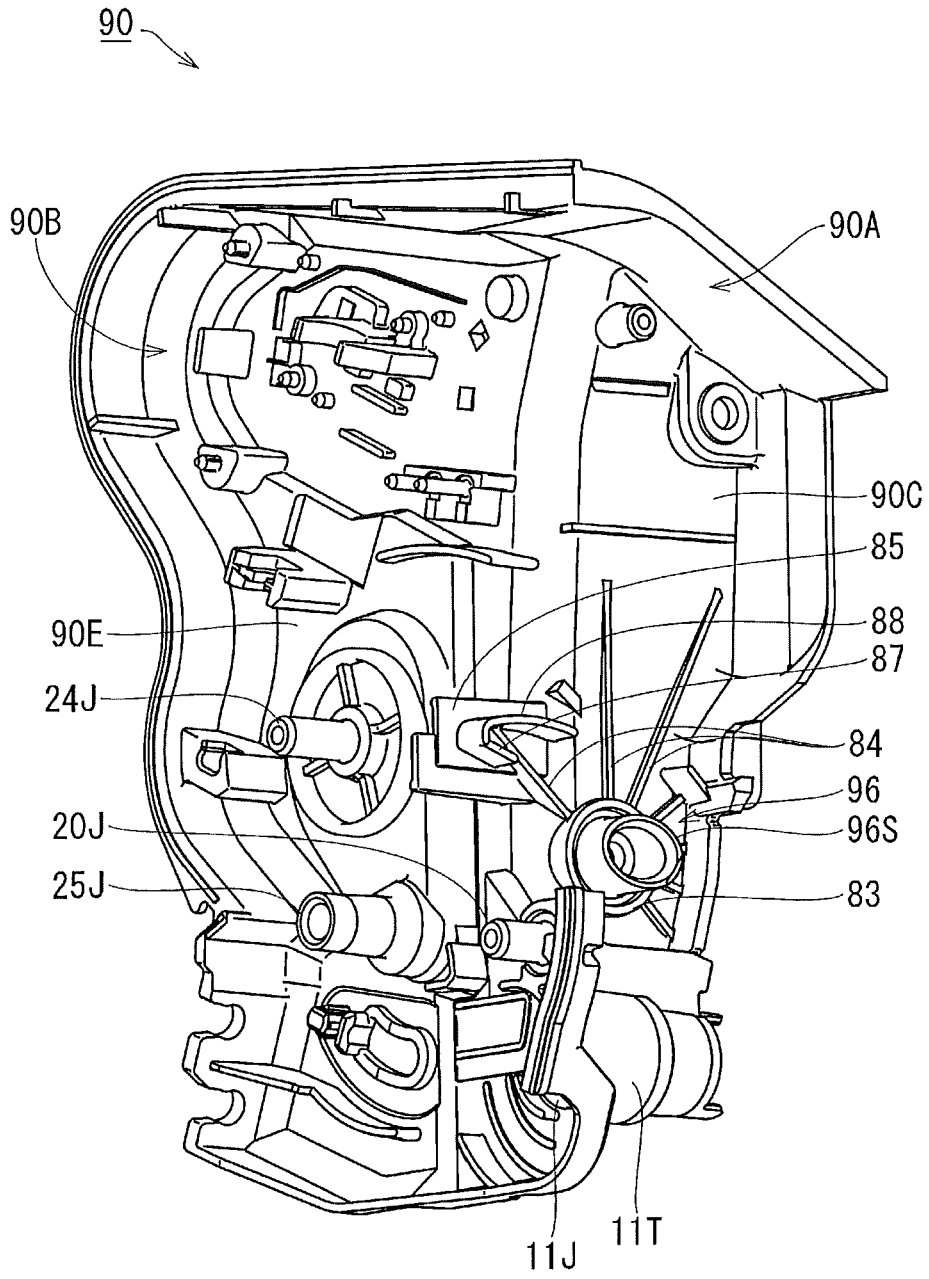
FIG. 13 Perspective view of an inner side of a support main body

As illustrated in FIG. 1, the outer surface reinforcing board 93 covers substantially entire outer surface of the first component support wall 11C except for an upper edge portion and a lower edge portion. In addition, a sheet metal groove 93M is formed at an intermediate position of the outer surface reinforcing board 93 in an up/down direction in a manner that the sheet metal groove 93 is extended horizontally and one end portion of the sheet metal groove 93M, which is at a side of the side protruding wall 91A, is opened. On the other hand, as illustrated in FIG. 13, a latch mechanism accommodation recessed portion 91B is formed in a recessed manner at a portion of the outer surface of the first component support wall 11C, the portion is covered with the outer surface reinforcing board 93. In addition, an inner deep surface groove 91M is formed at an inner deep surface of the latch mechanism accommodation recessed portion 91B, and one end portion of the inner deep surface groove 91M is opened to an outer surface of the side protruding wall 91A. As illustrated in FIG. 1, a striker receiving groove 12 is constituted by the sheet metal groove 93M and the inner deep surface groove 91M in an overlapped manner, and one end portion of the striker receiving groove 12 corresponds to a striker receiving opening 12K which is opened at a side of the side protruding wall 91A. In addition, the striker receiving groove 12 is exposed to an outside of the door 101 via a cut-out hole 101B (see FIG. 3 and FIG. 4) formed at the door 101, and a striker 15 (see FIG. 3) provided at an inner surface of a door frame 100W of the vehicle 100 is adapted to enter inside the striker receiving groove 12 from the striker receiving opening 12K when the door 101 closes.

Figure 12:
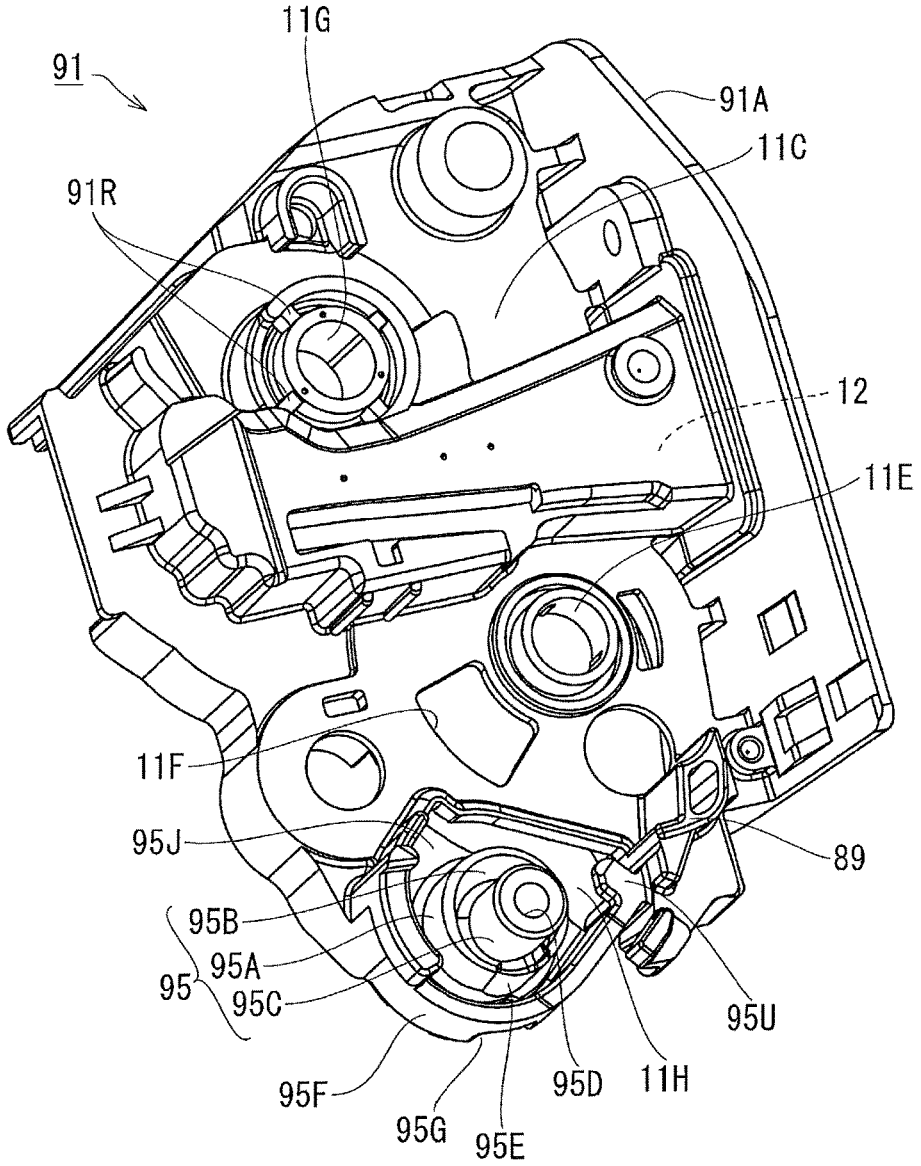
FIG. 12 Perspective view of an inner side of a first cover
Figure 22:
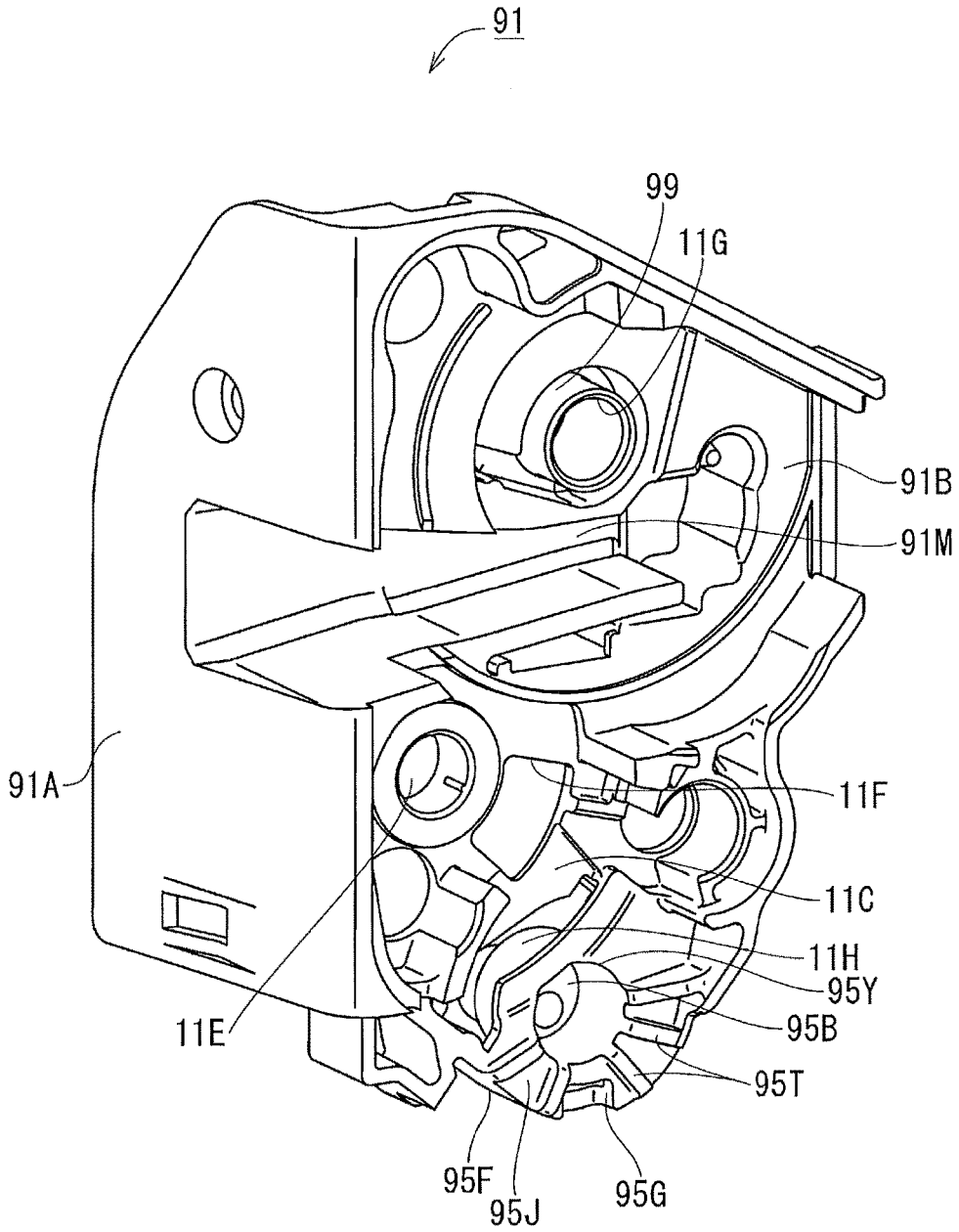

As illustrated in FIG. 22, a latch support hole 11G is formed at the first component support wall 11C at an upper side relative to the inner deep surface groove 91M and the latch support shaft 13J passes therethrough. In addition, as illustrated in FIG. 12, plural ribs 91R are formed at an outer circumferential surface of the latch support hole 11G in a radial manner and the latch support hole 11G is reinforced. Further, a ratchet support hole 11E is formed at the first component support wall 11C at a lower side relative to the inner deep surface groove 91M and the ratchet support shaft 14J passes therethrough. Then, both end portions of the latch support shaft 13J and the ratchet support shaft 14J are clinched and fixed to the outer surface reinforcing board 93 and to the inner surface reinforcing board 94.

The whole of the striker 15 includes a gate-shaped structure where, for example, wire material having a circular cross section is bent and curved, and a pair of leg portions of the gate-shaped structure protrudes from the inner surface of the door frame 100W and the leg portions are arranged side by side in an in/out direction. Then, a latch 13 which will be described later engages with one of the pair of leg portions of the striker 15, the one which is arranged closer to the outside.

Figure 6:
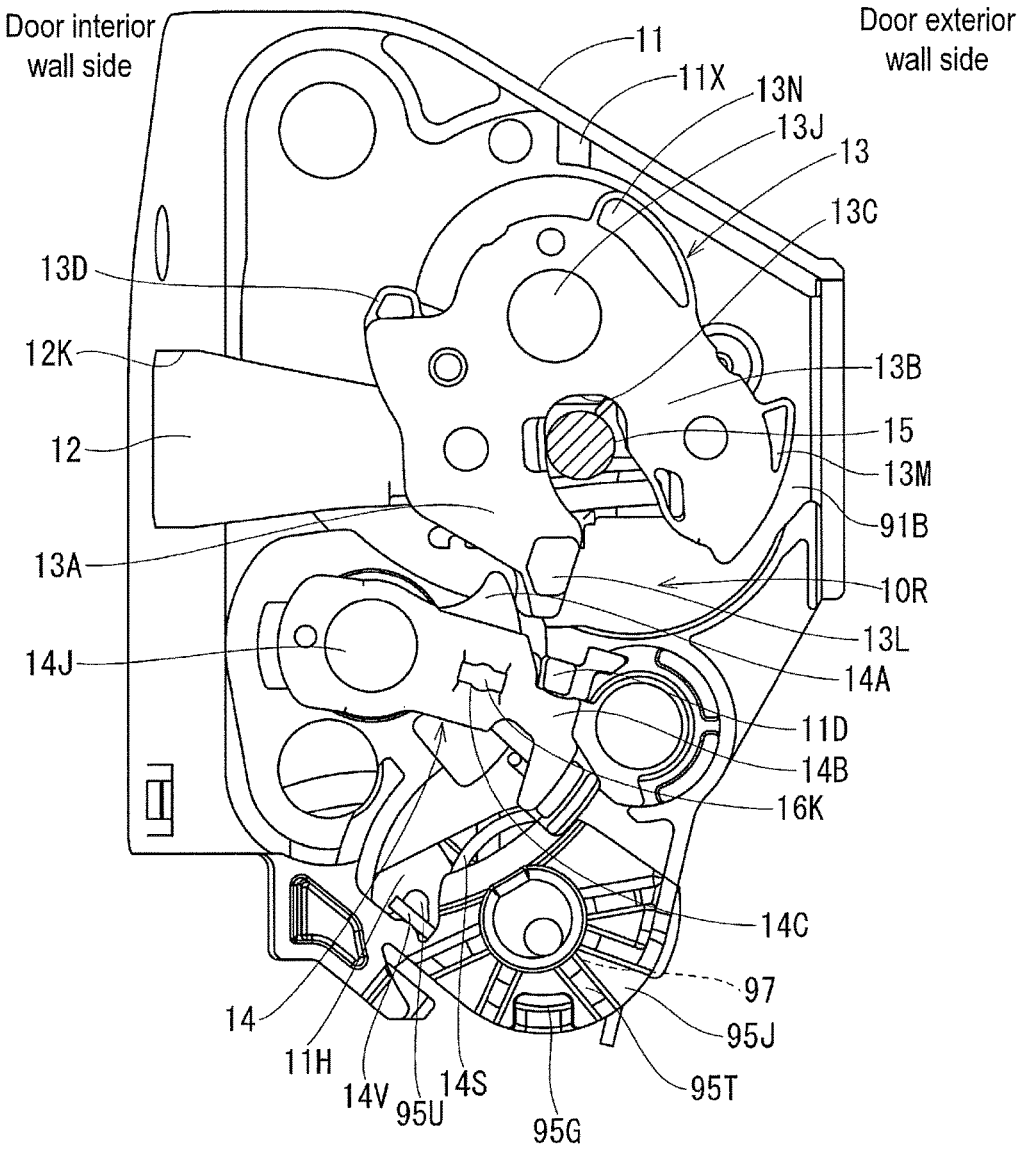

As illustrated in FIG. 5 and FIG. 6, the latch 13 and a ratchet 14 (which is also referred to as "pawl") of a latch mechanism 10R according to the present invention are accommodated in the latch mechanism accommodation recessed portion 91B. The latch 13 includes first and second locking tabs 13A, 13B which are parallel to each other. A striker receiving portion 13C is between the first and second locking tabs 13A and 13B, and the above-described latch support shaft 13J penetrates a portion of the latch 13 which connects the first and second locking tabs 13A and 13B to each other. The latch 13 is rotatably supported at the latch support shaft 13J.

In addition, as illustrated in FIG. 22, a spring accommodation groove 99 is formed at an inner deep surface of the latch mechanism accommodation recessed portion 91B in a manner that surroundings of the latch support hole 11G are recessed, and a torsion coil spring 13S for the latch (see FIG. 25) is accommodated therein. The latch 13 is biased in an unlatch direction (the clockwise direction in FIG. 5) by the torsion coil spring 13S for the latch. In a state where the door 101 is open, due to a contact of a stopper contact portion 13D provided at the latch 13 and a stopper 11X provided at the support body 11 with each other, the latch 13 is positioned at an unlatch position (the position shown in FIG. 5).

At the unlatch position, a state is formed where the first locking tab 13A withdraws above the striker receiving groove 12 and the second locking tab 13B crosses the striker receiving groove 12, and an opening end of the striker receiving portion 13C faces towards the striker receiving opening 12K of the striker receiving groove 12. Then, the striker 15 that enters into the striker receiving groove 12 is received within the striker receiving portion 13C, and the striker 15 pushes the second locking tab 13B and the latch 13 rotates in a latch direction (the counter-clockwise direction in FIG. 5). Accordingly, as illustrated in FIG. 6, the striker receiving groove 12 at a side of the striker receiving opening 12K relative to the striker 15 is covered with the first locking tab 13A, and the latch 13 is brought to a state of being engaged with the striker 15.

As illustrated in FIG. 5 and FIG. 6, first, second and third protruding portions 13L, 13M and 13N each protruding towards the outer surface reinforcing board 93 are provided at an end portion of the first locking tab 13A of the latch 13, at an end portion of the second locking tab 13B of the latch 13, and at a side edge portion of a portion connecting the first and second locking tabs 13A and 13B to each other. Accordingly, in a case where the latch 13 moves towards the outer surface reinforcing board 93 in a direction of a rotational axis, the first, second and third protruding portions 13L, 13M and 13N make contact with the outer surface reinforcing board 93, and thus the latch 13 is restricted from moving. Accordingly, looseness of the latch 13 in the direction of the rotational axis can be reduced.

The ratchet 14 is arranged at a lower side relative to the latch 13 and is rotatably supported by the above-described ratchet support shaft 14J. In addition, the ratchet 14 is provided with a stopper piece 14B extending from the ratchet support shaft 14J towards a side opposite to the striker receiving opening 12K, and a latch rotation restriction piece 14A is structured to protrude upwardly from an intermediate position of the stopper piece 14B. Further, the ratchet 14 is biased by a latch-holding torsion coil spring 14S (see FIG. 14) in the counter-clockwise direction in FIG. 5. Normally, the ratchet 14 is positioned at an original position due to a contact of the stopper piece 14B and a ratchet stopper 11D provided at the support body 11 with each other. When the door 101 closes, the latch 13 that is pushed and rotated by the striker 15 pushes down the latch rotation restriction piece 14A of the ratchet 14 and passes the latch rotation restriction piece 14A. Then, the ratchet 14 returns to the original position and, as illustrated in FIG. 6, the latch rotation restriction piece 14A of the ratchet 14 is abutted with the first locking tab 13A of the latch 13 from a side opposite to the striker receiving portion 13C, and accordingly the latch 13 is maintained in a state where the latch 13 engages with the striker 15. In this way, the door 101 is latched to a closed state by the latch mechanism 10R. The latch rotation restriction piece 14A is wrapped with resin, and a contact of the ratchet 14 and the latch 13 with each other corresponds to a contact of resin material and resin material with each other.

Figure 4:
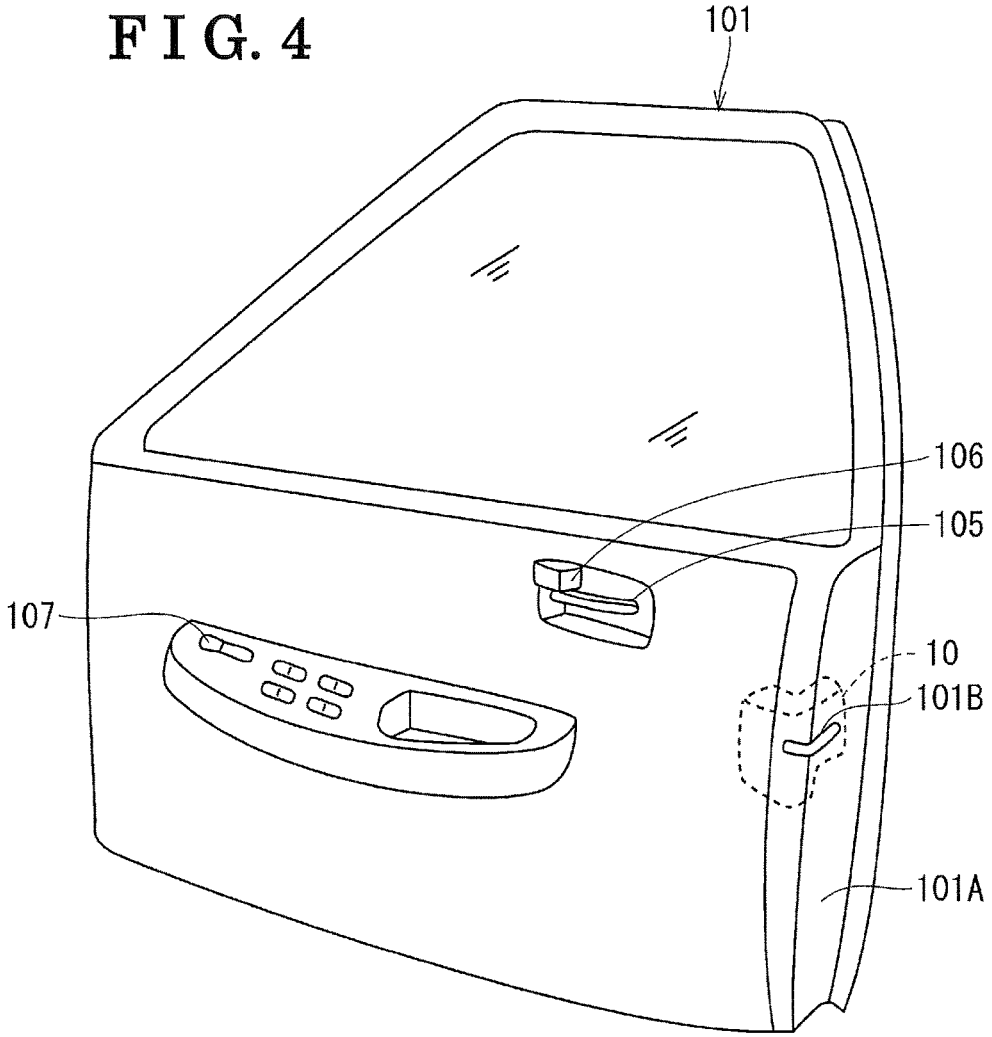
Figure 7:
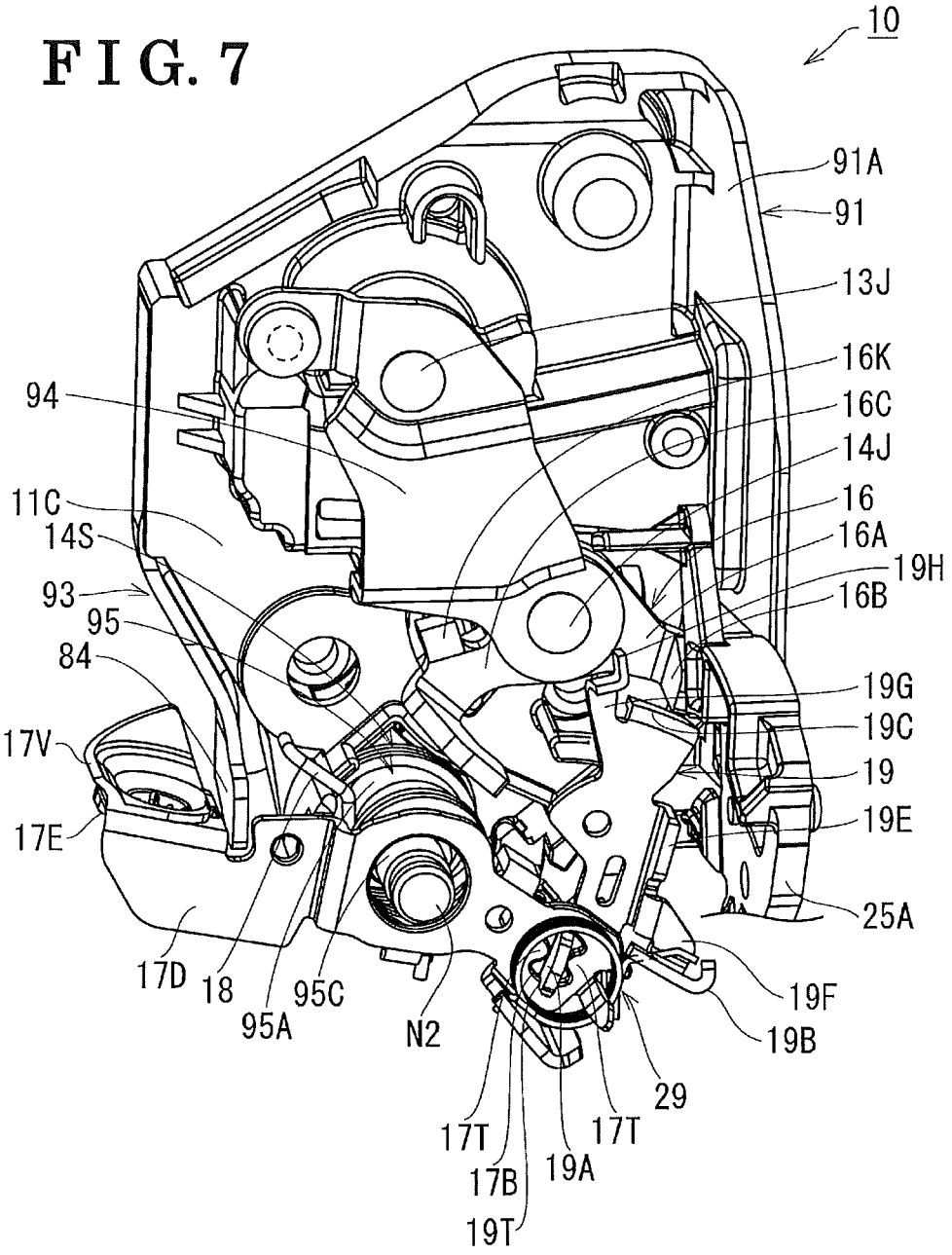

A rotation restriction imposed by the ratchet 14 on the latch 13 can be released by operating either an outside door handle 104 provided at a vehicle outside surface of the door 101 as illustrated in FIG. 3 or an inside door handle 105 provided at a vehicle inside surface of the door 101 as illustrated in FIG. 4. To receive an operation force from the outside door handle 104 and the inside door handle 105, the latch mechanism 1 OR is provided with a lift lever 16 at the inner surface of the first cover 91 as illustrated in FIG. 7.

The lift lever 16 made from, for example, sheet metal is arranged at an inner surface-side of the first component support wall 11C and is rotatably supported by the ratchet support shaft 14J. In addition, the lift lever 16 is provided with a first tilt arm 16A protruding from the ratchet support shaft 14J towards a side of the striker receiving opening 12K of the striker receiving groove 12 (see FIG. 5) (which will be hereunder referred to as "a front side" and a side opposite thereto will be referred to as "a rear side") and is provided with a second tilt arm 16C protruding from the ratchet support shaft 14J obliquely downwardly towards the rear side. An engagement protruding piece 16K is bent from an upper edge of the second tilt arm 16C at the right angle. The engagement protruding piece 16K protrudes towards and enters into the latch mechanism accommodation recessed portion 91B (see FIG. 5) via a through hole 11F, which is illustrated in FIG. 12, of the first component support wall 11C, and the engagement protruding piece 16K engages, by a concavo-convex engagement, with an engagement hole 14C (see FIG. 5) provided at the ratchet 14. Accordingly, the lift lever 16 and the ratchet 14 rotate integrally with each other. In addition, as illustrated in FIG. 7, a latch release portion 16B according to the present invention is provided at the first tilt arm 16A. The latch release portion 16B includes a structure of a protruding piece where, for example, a distal end portion of the first tilt arm 16A is folded towards the main body 90 so as to protrude.

Figure 10A:
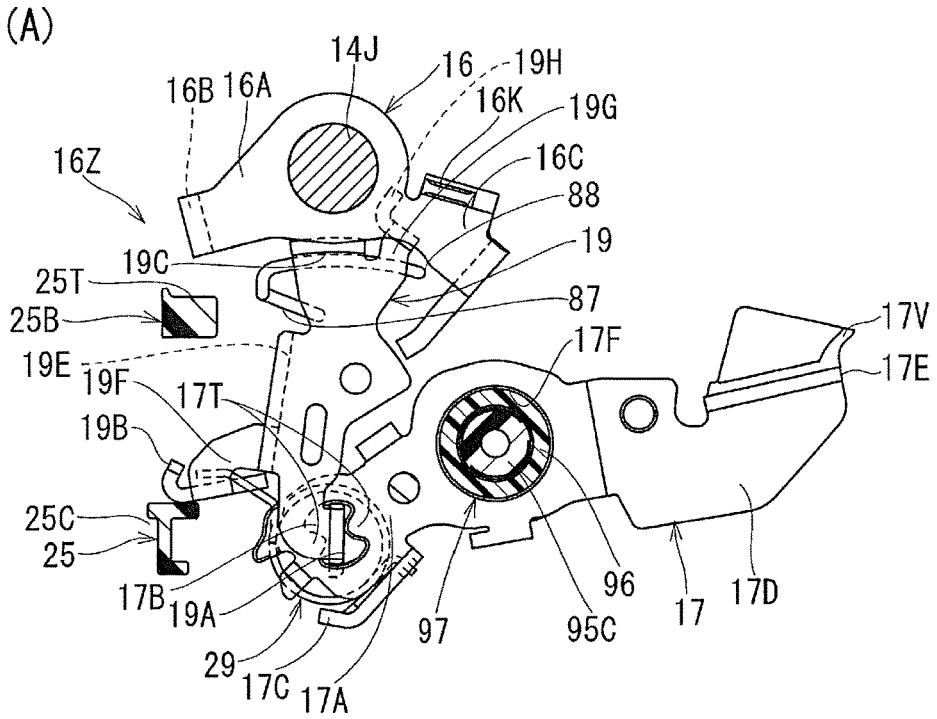
FIG. 10B Side view of the lift lever, the open link and the like before the door handle operation in an unlocked state (an unlock waiting position)
Figure 14:
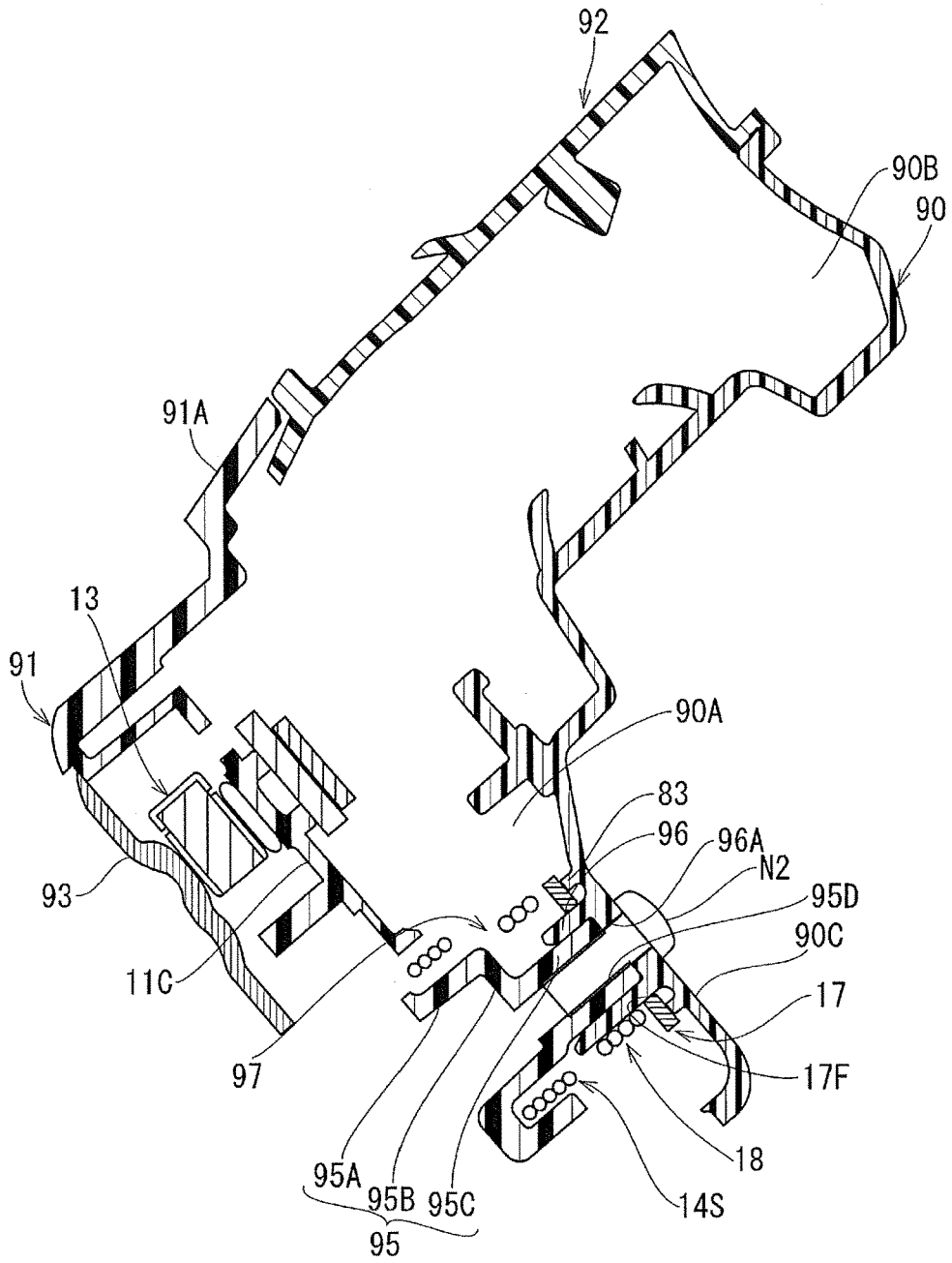
FIG. 14 Cross-sectional view of the door lock device

As illustrated in FIG. 10A, an open lever rotation support shaft portion 97 (which corresponds to "a lever support shaft portion" according to the present invention) is provided at an obliquely lower position at a rear side relative to the ratchet support shaft 14J, and an outside handle interlock lever 17 (which corresponds to "a handle interlock lever" according to the present invention) is rotatably supported at the open lever rotation support shaft portion 97. As illustrated in FIG. 14, the open lever rotation support shaft portion 97 is constituted by a support protruding portion 95 protruding from the first component support wall 11C of the first cover 91 and a support cylinder portion 96 protruding from the second component support wall 90C positioned at the inner deep side of the first component accommodation portions 90A of the main body 90. Specifically, as illustrated in FIG. 22, a lower portion of the first component support wall 11C which is lower than the latch mechanism accommodation recessed portion 91B corresponds to a protruding portion support wall 95J according to the present invention and the support protruding portion 95 is formed to protrude from the protruding portion support wall 95J towards the first component accommodation portion 90A. As illustrated in FIG. 12, the support protruding portion 95 is constituted by a large diameter shaft portion 95A rising from the protruding portion support wall 95J, a distal end wall 95B obstructing a distal end thereof, and a small diameter shaft portion 95C protrudingly formed at a position that is eccentric downwardly from a center of the distal end wall 95B. A hole 95D is formed at a central portion of the small diameter shaft portion 95C. In addition, a step opening 11H is formed at an upper position at an obliquely front side relative to the support protruding portion 95 in a manner that a wall of a stepped portion between the protruding portion support wall 95J and the inner deep surface of the latch mechanism accommodation recessed portion 91B is cut out and removed.

Figure 24:
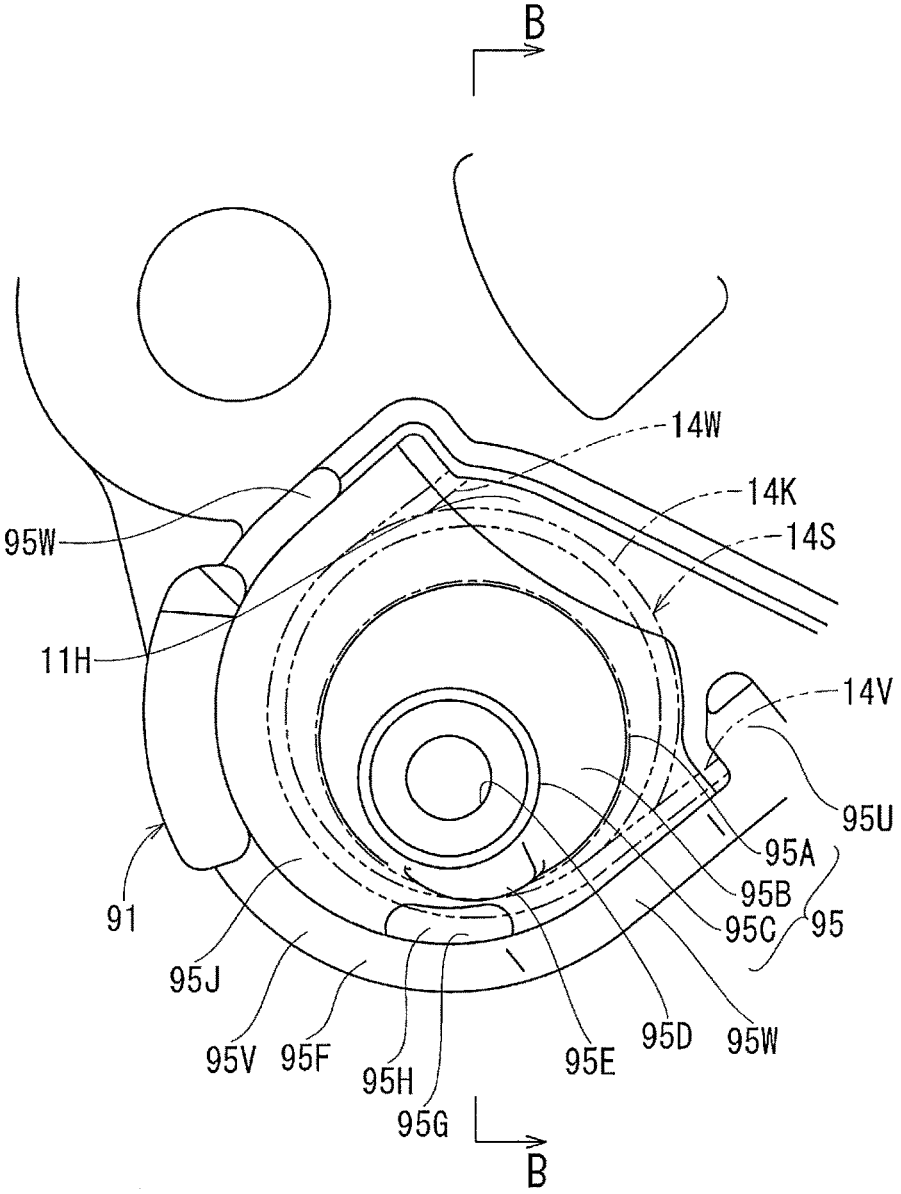

In addition, a surrounding wall 95F is protrudingly formed at the protruding portion support wall 95J so as to surround the large diameter shaft portion 95A from all lateral sides except for an upper side at an obliquely front side thereof. As illustrated in FIG. 24, the surrounding wall 95F is structured to include a circular arc portion 95V which is curved in a circular shape and which corresponds from a portion positioned below the support protruding portion 95 to a portion positioned at a rear side, and to include a pair of linear portions 95W, 95W extended obliquely upwardly from both end portions of the circular arc portion 95V to the step opening 11H. Further, a lock protrusion 95U protrudes inwardly from a position, the position being apart from the protruding portion support wall 95J, of an inner surface of the surrounding wall 95F at one end portion positioned at a front side relative to the large diameter shaft portion 95A. Then, a coil portion 14K of the latch-holding torsion coil spring 14S is inserted at an outer side of the large diameter shaft portion 95A and is accommodated between the large diameter shaft portion 95A and the surrounding wall 95F. A first lock arm 14V provided to extend from one end portion of the coil portion 14K is engaged and locked at an inner side of the lock protrusion 95U (see FIG. 5 and FIG. 6) while a second lock arm 14W provided to extend from the other end portion of the coil portion 14K protrudes towards and enters inside the latch mechanism accommodation recessed portion 91B via the step opening 11H, and is locked at the ratchet 14 (see FIG. 5).

Figure 23:
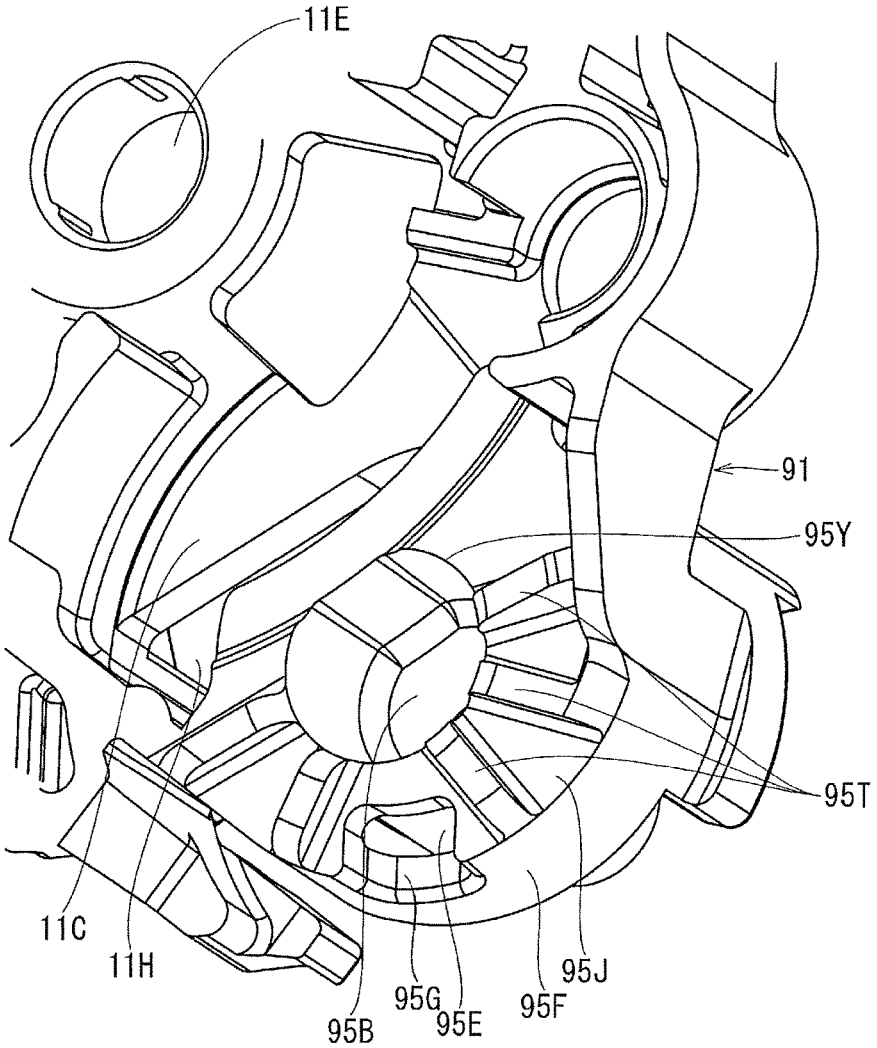
Figure 26:
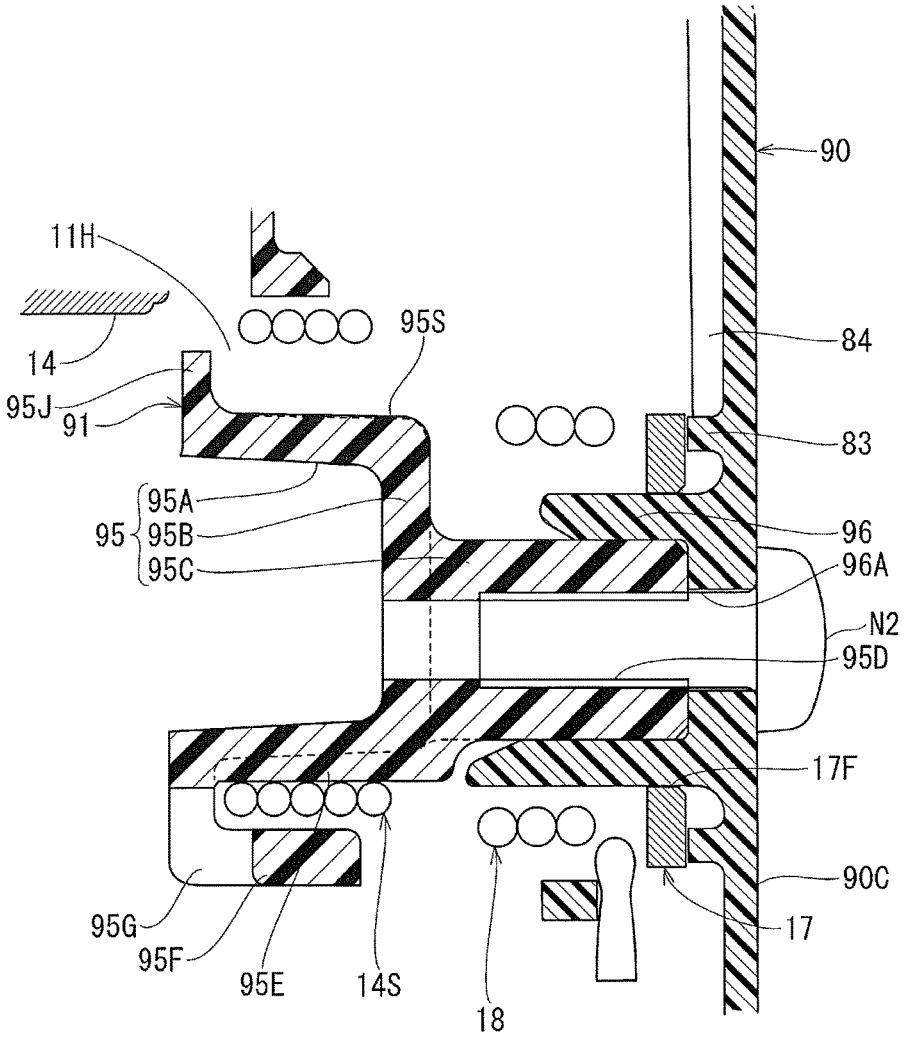
FIG. 26 Cross-sectional view of the door lock device which is taken along line B-B of FIG. 24

In addition, an inner diameter of the coil portion 14K of the latch-holding torsion coil spring 14S includes a size that can be loosely fitted at the large diameter shaft portion 95A, and an inner surface of the coil portion 14K is in contact with a lowest portion of the large diameter shaft portion 95A and is positioned thereat. Here, as illustrated in FIG. 26 in an emphasized manner, an outer circumferential surface of the large diameter shaft portion 95A is a sloped outer circumferential surface 95S provided with a draft angle so that the large diameter shaft portion 95A is easily taken out of a forming die when the first cover 91 is injection-molded. Thus, if the coil portion 14K is pressed against the outer circumferential surface of the large diameter shaft portion 95A, the coil portion 14K may be dislocated towards the distal end of the large diameter shaft portion 95A due to the draft angle. In contrast, in the present embodiment, a coil contact protrusion 95E is formed at the outer circumferential surface of the large diameter shaft portion 95A, at the lowest portion of the outer circumferential surface with which the coil portion 14K is in contact. The coil contact protrusion 95E includes a configuration extending in an axial direction of the large diameter shaft portion 95A and protruding downwardly in an expanded manner, and a ridge line positioned at a lowest portion of the coil contact protrusion 95E is parallel to a central axis of the large diameter shaft portion 95A. Because the inner surface of the coil portion 14K makes contact with the coil contact protrusion 95E, the coil portion 14K is positioned without being dislocated towards the distal end of the large diameter shaft portion 95A. As illustrated in FIG. 23, a lower end opening 95G is formed below the coil contact protrusion 95E by cutting out and removing a part of a corner portion at which the protruding portion support wall 95J and the surrounding wall 95F intersect with each other.

As illustrated in FIG. 22, a central opening 95Y which is in communication with an inside of the large diameter shaft portion 95A is formed at an outer surface of the protruding portion support wall 95J, and plural support shaft portion reinforcing ribs 95T are extended radially from the central opening 95Y. More specifically, among the plural support shaft portion reinforcing ribs 95T, the support shaft portion reinforcing rib 95T at one end of circumference of the central opening 95Y extends from the central opening 95Y obliquely downwardly towards the front side while the support shaft portion reinforcing rib 95T at the other end extends from the central opening 95Y obliquely upwardly towards the rear side at a position apart from the support shaft portion reinforcing rib 95T at the one end by substantially nearly 180 degrees. The other plural support shaft portion reinforcing ribs 95T are arranged in a distributed manner at positions between the support shaft portion reinforcing rib 95T at the one end and the support shaft portion reinforcing rib 95T at the other end, avoiding the lower end opening 95G. Both distal end portions of each support shaft portion reinforcing rib 95T in a lengthwise direction thereof are rounded in a manner that each support shaft portion reinforcing rib 95T becomes gradually lower towards distal ends in the lengthwise direction.

Figure 25:
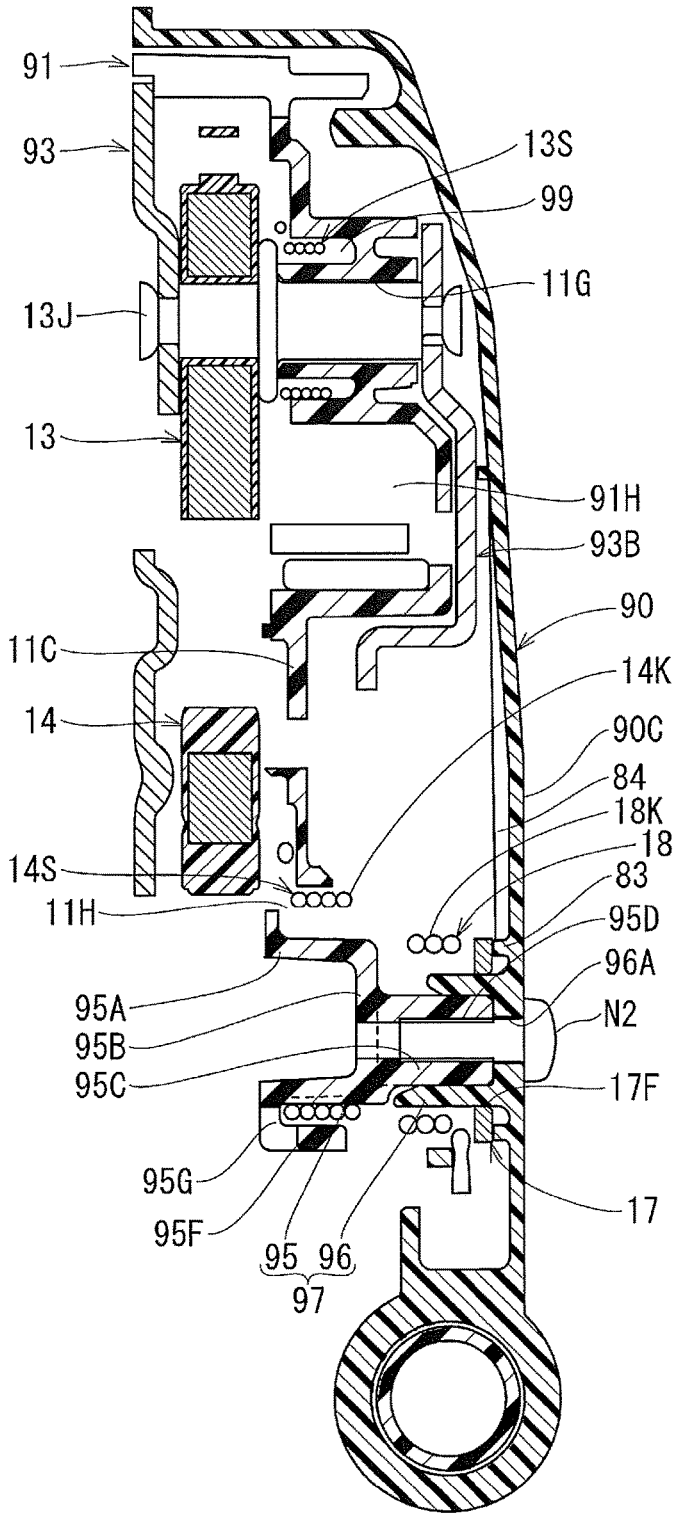

As illustrated in FIG. 13, the support cylinder portion 96 is formed to include a distal end sloped surface 96S where a distal end of a cylindrical body protruding from the second component support wall 90C is cut obliquely. As illustrated in FIG. 25, a through hole 96A is formed at the second component support wall 90C, on a center of the support cylinder portion 96. Then, a tapping screw N2 is tightened into a hole 95D via the through hole 96A in a state where the small diameter shaft portion 95C of the support protruding portion 95 is inserted inside the support cylinder portion 96, and thus the open lever rotation support shaft portion 97 is constituted by the support protruding portion 95 and the support cylinder portion 96. In addition, as illustrated in FIG. 13, an annular protrusion 83 is protrudingly formed at the second component support wall 90C, around the support cylinder portion 96 on a concentric circle that is concentric with the support cylinder portion 96, and plural reinforcing ribs 84 (corresponding to "auxiliary wall reinforcing rib" according to the present invention) extend from the annular protrusion 83 in a radial manner. In addition, amount of protrusion of the reinforcing ribs 84 from the second component support wall 90C is smaller than the annular protrusion 83. Then, as illustrated in FIG. 25, the support cylinder portion 96 of the open lever rotation support shaft portion 97 is inserted into a through hole 17F of the outside handle interlock lever 17 to a base end portion of the support cylinder portion 96, and an opening edge of the through hole 17F is placed at the annular protrusion 83. In addition, a coil portion 18K of a torsion coil spring 18 for the handle interlock lever is inserted at an outer side of the support cylinder portion 96.

The outside handle interlock lever 17 is made from sheet metal and is provided with the shaft insertion hole 17F, and the support cylinder portion 96 of the open lever rotation support shaft portion 97 is inserted therethrough, and as illustrated in FIG. 14, the opening edge of the shaft insertion hole 17F is applied to the annular rib 83. In addition, as illustrated in FIG. 10A, the outside handle interlock lever 17 includes a support arm 17A protruding towards a front side from the open lever rotation support shaft portion 97 and an operation arm 17D protruding towards a rear side from the open lever rotation support shaft portion 97. The outside handle interlock lever 17 is biased by the torsion coil spring 18 for the handle interlock lever, which is illustrated in FIG. 8, in a direction in which the support arm 17A is lowered and the outside handle interlock lever 17 is normally positioned at an original position (see FIG. 10A and FIG. 10B) at which an upper edge portion of the operation arm 17D is in contact with a stopper portion 90S formed integrally at the main body 90. As illustrated in FIG. 14, the torsion coil spring 18 for the handle interlock lever is inserted at the outer side of the support cylinder portion 96 and the coil portion of the latch-holding torsion coil spring 14S is inserted at an outer side of the large diameter shaft portion 95A.

In addition, from an upper edge of a rear end of the operation arm 17D, a rod locking piece 17E is bent at the right angle and a resin ring 17V is attached to a through hole formed at the rod locking piece 17E. In addition, one end portion of a rod, which is not shown, is connected to an inner side of the resin ring 17V and the other end portion of the rod is connected to the outside door handle 104 of the door 101 illustrated in FIG. 3. Then, in a case where the outside door handle 104 is operated, the rod locking piece 17E is pushed downwardly, and thus the outside handle interlock lever 17 rotates from the original position (FIG. 10A and FIG. 10B) to an operation position (FIG. 11A and FIG. 11B).

In addition, from a lower end portion of a distal end of the support arm 17A, a pressure receiving piece 17C is bent towards the second component support wall 90C (towards an opposite side to the first component support wall 11C) to protrude.

At the original position, the outside handle interlock lever 17 is in a posture where the support arm 17A is tilted forward and downward (see FIG. 10A). At the operation position, the outside handle interlock lever 17 comes to be in a posture where the support arm 17A comes closer to be in a horizontal posture and is slightly tilted forward and downward (see FIG. 11A).

As illustrated in FIG. 10A, a tilt connection hole 17B according to the present invention is formed in a penetrating manner at a distal end portion of the support arm 17A so as to pass therethrough in a direction that is parallel to an axial direction of the open lever rotation support shaft portion 97. The tilt connection hole 17B is formed in a shape that includes a pair of mound-shaped protruding portions 17T, 17T protruding from two positions which are at an inner peripheral surface of the circular hole and are apart from each other by 180 degrees, and the mound-shaped protruding portions 17T, 17T protrude towards a side at which the mound-shaped protruding portions 17T, 17T come close to each other. Then, a lower end portion of an open link 19 is connected to the tilt connection hole 17B. In addition, a lock switch mechanism 16Z is constituted by the open link 19 and the lift lever 16.

Figure 17:
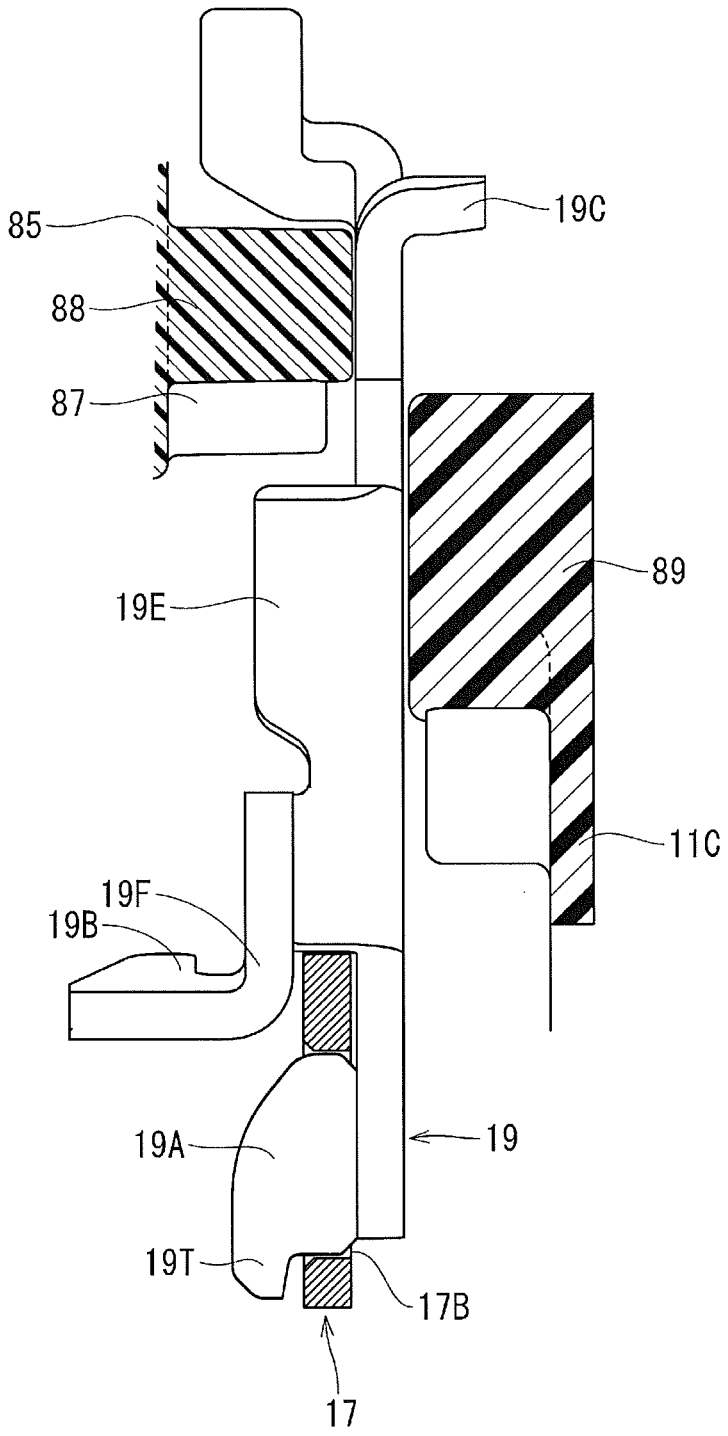

The open link 19 is made from metal sheet and, as illustrated in FIG. 7, the open link 19 is formed in a vertically-elongated shape in a manner that the whole of the open link 19 is extended in the up/down direction. The lower end portion of the open link 19 is overlapped relative to the outside handle interlock lever 17 from a side of the first component support wall 11C. Then, a tilt connection protruding piece 19A according to the present invention is provided at the lower end portion of the open link 19. As illustrated in FIG. 10A, the tilt connection protruding piece 19A is formed in a manner that a rear edge portion of the lower end portion of the open link 19 is bent towards the side opposite to the first component support wall 11C as illustrated in FIG. 17. In addition, a distal end portion of the tilt connection protruding piece 19A is expanded downwardly and thus a distal end wide width portion 19T is provided at the tilt connection protruding piece 19A. Then, before the outside handle interlock lever 17 is assembled to the open lever rotation support shaft portion 97, the distal end wide width portion 19T is inserted between the pair of mound-shaped protruding portions 17T, 17T (see FIG. 10A) of the tilt connection hole 17B in a state where the open link 19 is in a laterally-inclined posture where the open link 19 is inclined relative to the outside handle interlock lever 17 towards a side (the right side in FIG. 17) at which an upper end side of the open link 19 is away from the outside handle interlock lever 17, and then the open link 19 is changed to be in a normal posture (an upright posture). Accordingly the tilt connection protruding piece 19A is prevented from coming off out of the tilt connection hole 17B. Then, in a state where the first cover 91 is assembled to the main body 90 and the outside handle interlock lever 17 is supported at the open lever rotation support shaft portion 97, the open link 19 is tilted about a tilt axis (an imaginary axis passing through a center of the tilt connection hole 17B) that is parallel to the open lever rotation support shaft portion 97. In addition, a torsion coil spring 29 (which corresponds to "a tilt biasing spring" according to the present invention) is attached between the open link 19 and the outside handle interlock lever 17, and one end portion of the torsion spring 29 engages with a rear end portion-side of the pressure receiving piece 17C of the outside open lever 17 while the other end portion engages with a rear end portion of a lock-release piece 19B which will be described below. Then, the open link 19 is biased by the torsion coil spring 29 in the counter-clockwise direction in FIG. 10A. Further, a tilt range of the open link 19 is restricted by a contact between the pair of mound-shaped protruding portions 17T, 17T and the tilt connection protruding piece 19A. A limit position at which the open link 19 is capable of tilting forward will be hereinafter referred to as "a start position" and a limit position at which the open link 19 is capable of tilting rearward will be referred to as "an end position".

Figure 9:
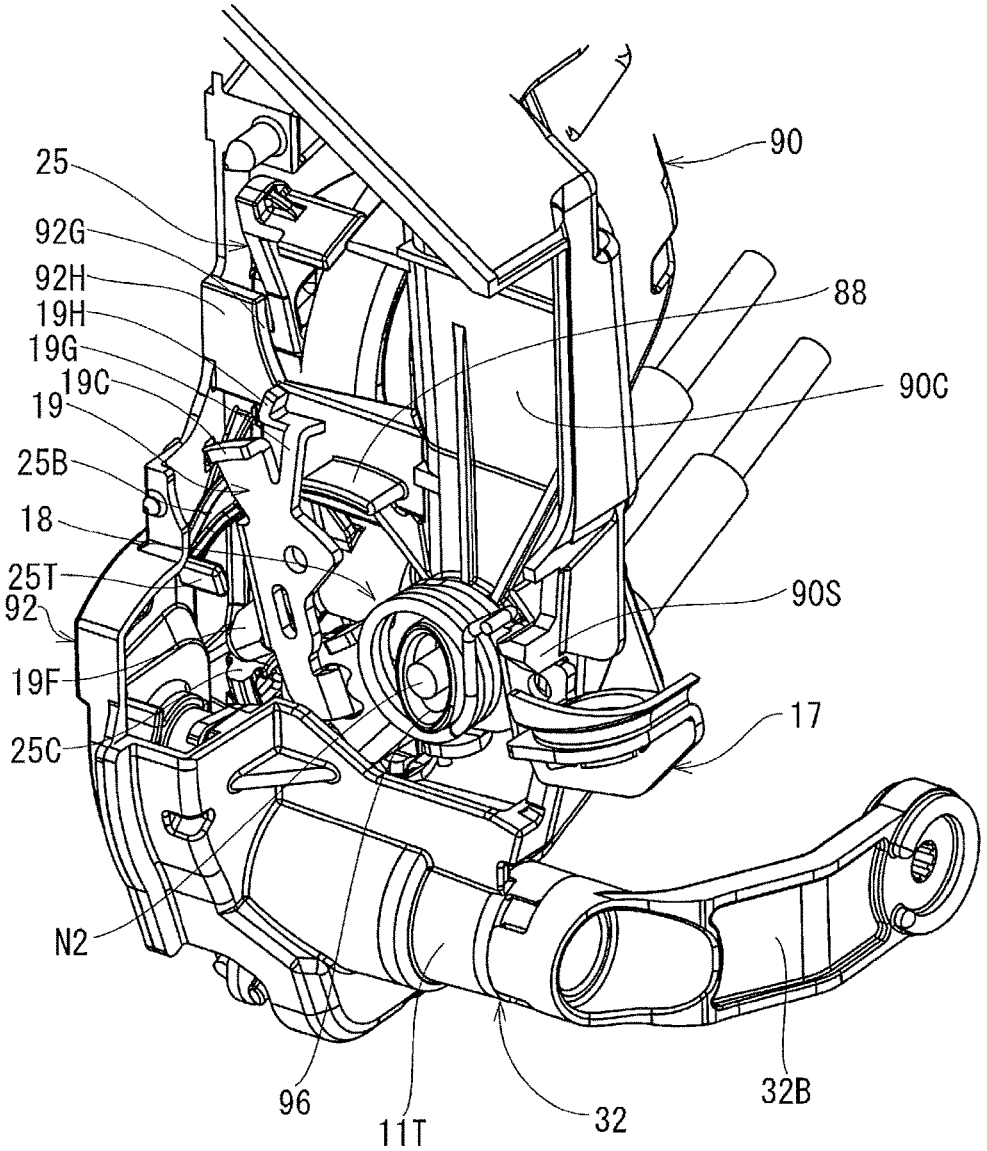

In addition, the tilt range of the open link 19 is restricted by an active lever 25 which will be described below. As illustrated in FIG. 7, the open link 19 is provided with the lock-release piece 19B and a sliding-contact protruding piece 19E so that the open link 19 receives the tilt restriction imposed by the active lever 25. The lock-release piece 19B is formed in such a manner that a lower edge portion of a lower end arm 19F protruding forward from a portion of the open link 19 which is close to a lower end of the open link 19 is bent towards the second component support wall 90C (towards the side opposite to the first component support wall 11C) and a front end portion-side thereof is bent and raised upwardly. In addition, the sliding-contact protruding piece 19E is bent from a front edge portion of an intermediate portion of the open link 19 in the up/down direction towards the second component support wall 90C (towards the side opposite to the first component support wall 11C) so as to protrude. In addition, a push-up protruding piece 19C protrudes from an upper edge portion of the open link 19 by being bent towards the first component support wall 11C. Further, from a rear side portion, relative to the push-up protruding piece 19C, of the upper edge portion of the open link 19, an upper portion extended piece 19G protrudes above the push-up protruding piece 19C. Further, an upper end sliding-contact portion 19H including a shape of a letter L is formed in a manner that a belt-shaped piece extended forward from an upper edge portion of the upper portion extended piece 19G is bent towards the second component support wall 90C and a front-side portion of the belt-shaped piece is bent and raised. As illustrated in FIG. 9, a guide protruding piece 92H protrudes from the second cover 92 at an obliquely upper front side relative to the upper end sliding-contact portion 19H. At a distal end edge of the guide protruding piece 92H which faces towards the upper end sliding-contact portion 19H, a sliding-contact guide portion 92G which rises perpendicularly from a lower end portion and is curved in the middle to extend towards an obliquely upper front side is provided.

Figure 15:
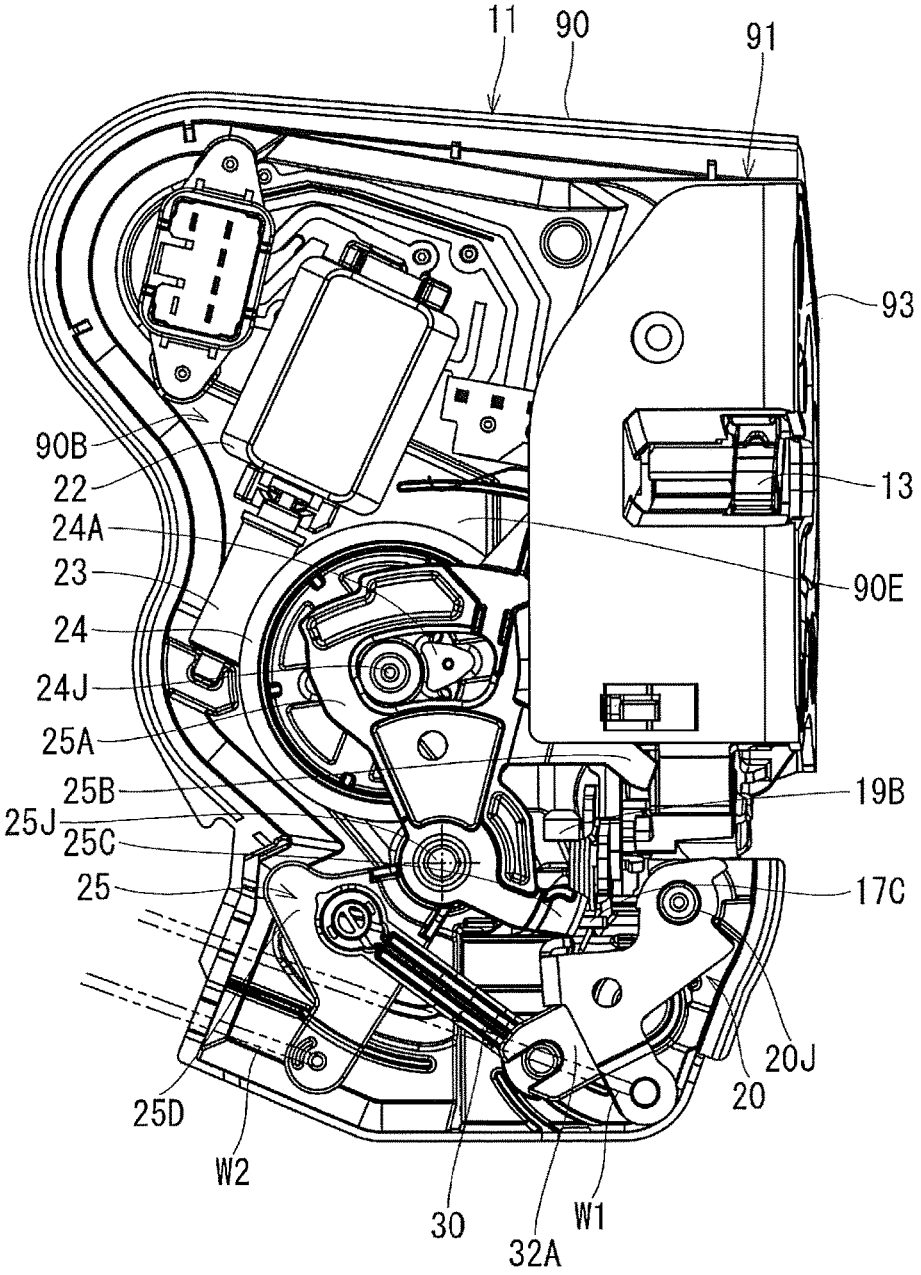
FIG. 15 Front view of a state in which the components are attached to a third component support wall FIG. 16 Enlarged perspective view of the state in which the components are attached to the third component support wall FIG. 17 Front view of the open link FIG. 18 Side view of a handle interlock lever and the open link FIG. 19 Side view of the handle interlock lever and the open link FIG. 20 Side view of the handle interlock lever and the open link FIG. 21 Side view of the handle interlock lever and the open link FIG. 22 Perspective view of an outer side of the first cover FIG. 23 Partly enlarged perspective view of the outer side of the first cover FIG. 24 Partly enlarged back view of an inner side of the first cover FIG. 25 Cross-sectional view of the door lock device which is taken along line A-A of FIG. 1
Figure 16:
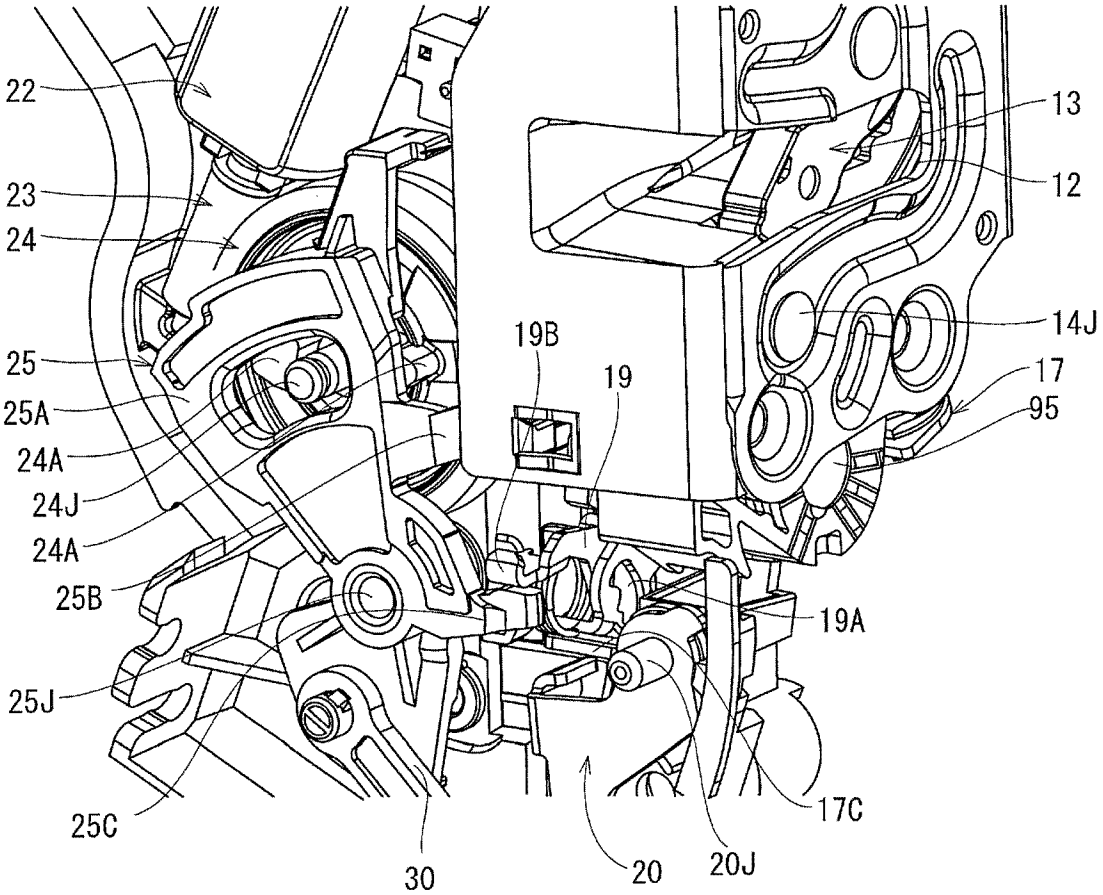

As illustrated in FIG. 13, an open lever support shaft portion 20J is protrudingly formed at a third component support wall 90E positioned at an inner deep side of the second component accommodation portion 90B of the support body 11, at a position close to a right lower end. An inside open lever 20 illustrated in FIG. 15 is rotatably supported by the open lever support shaft portion 20J. In addition, the inside door handle 105 is connected to the inside open lever 20 via a wire W1. In a case where the inside door handle 105 is operated, the inside open lever 20 rotates in the clockwise direction in FIG. 15 and pushes up the pressure receiving piece 17C of the outside handle interlock lever 17 described above, thereby causing the outside handle interlock lever 17 to rotate from the original position to the operation position.

As illustrated in FIG. 13, at the third component support wall 90E, an active lever support shaft portion 25J is protrudingly formed at a position close to a central lower end in a right/left direction and a wheel support shaft portion 24J is protrudingly formed at a substantially central portion in the up/down and right/left directions. As illustrated in FIG. 15, the active lever 25 is rotatably supported at the active lever support shaft 25J while a worm wheel 24 is rotatably supported at the wheel support shaft portion 24J. In addition, a motor 22 is attached to the third component support wall 90E, at an obliquely left upper position relative to the worm wheel 24. Further, a worm gear 23 provided at a rotational shaft of the motor 22 meshes with the worm wheel 24. Then, in response to an operation of a centralized lock operation switch 107 (see FIG. 4) inside the vehicle and/or a wireless key 108 (see FIG. 3), the motor 22 drives the worm wheel 24 to rotate in one direction and the other direction, and at this time, engagement protruding portions 24A, 24A provided at the worm wheel 24 make contact with the active lever 25 and drive the active lever 25 to rotate between an unlock position and a lock position.

As illustrated in FIG. 15, the active lever 25 is provided with a first fan-shaped protruding piece 25A projecting upwardly from the active lever support shaft portion 25J, a second fan-shaped protruding piece 25D formed in a fan shape and projecting from the active lever support shaft portion 25J obliquely downwardly towards a left side, and an active operation arm 25C (which corresponds to "a link waiting position determination portion" according to the present invention) projecting from the active lever support shaft portion 25J towards obliquely right side.

Figure 10B:
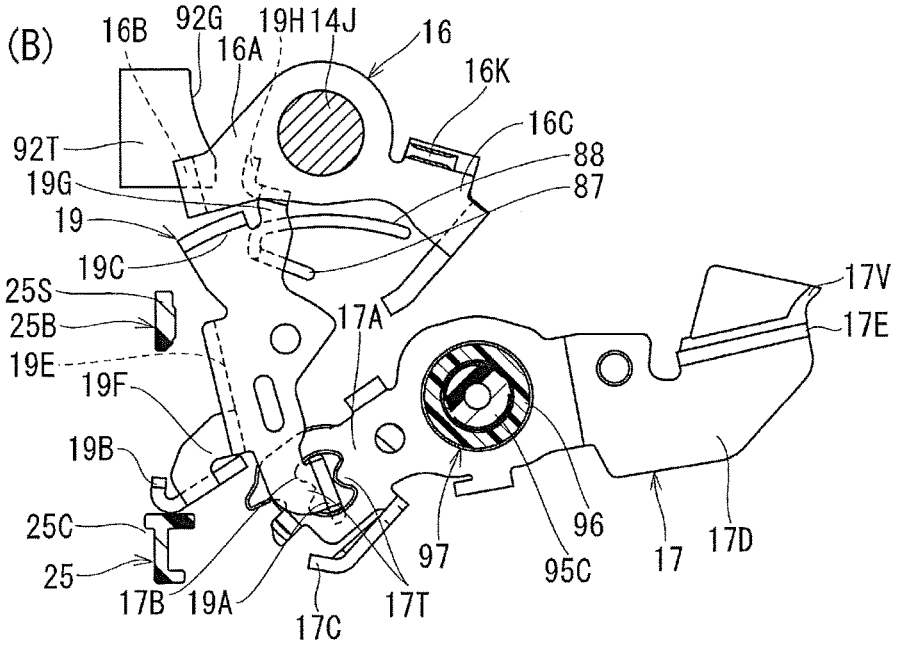
Figure 11A:
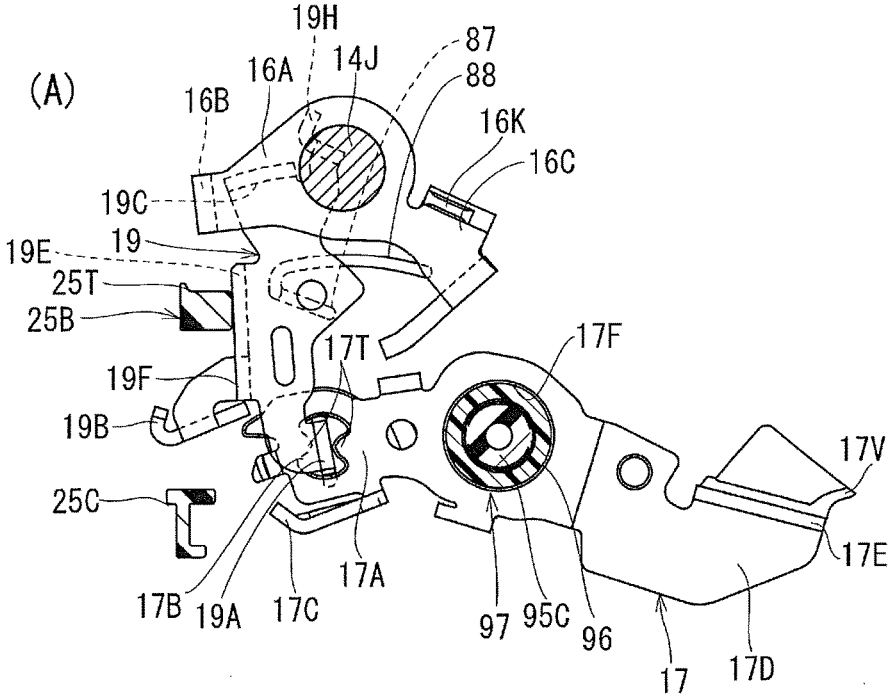
FIG. 11A Side view of the lift lever, the open link and the like after the door handle operation in the locked state (a lock position)
Figure 11B:
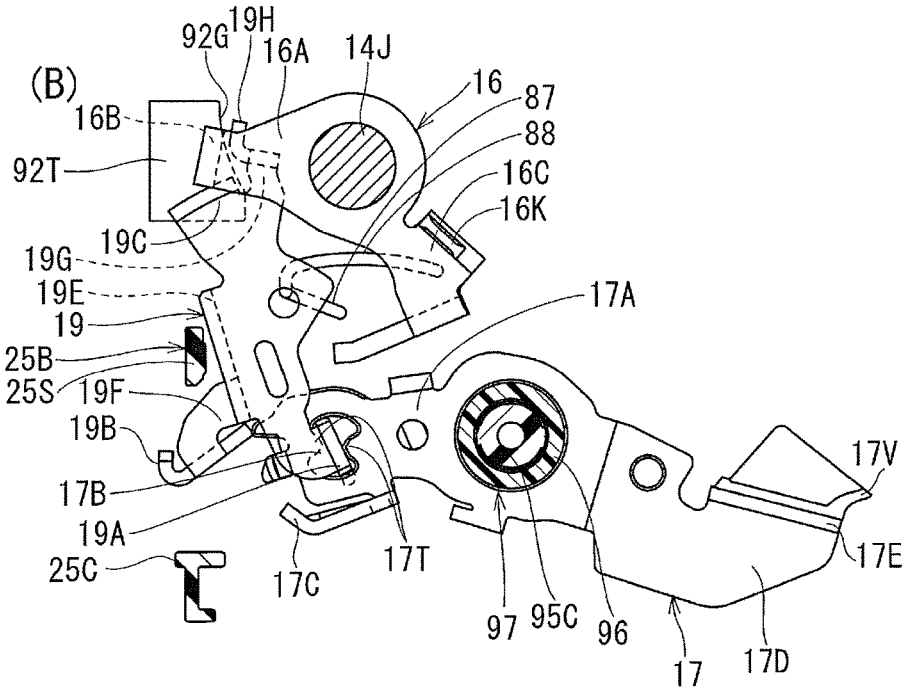
FIG. 11B Side view of the lift lever, the open link and the like after the door handle operation in the unlocked state (an unlock position)

As illustrated in FIG. 10A and FIG. 10B, in a state where the outside handle interlock lever 17 is positioned at the original position, a distal end portion of the active operation arm 25C is in contact with the lock-release piece 19B of the open link 19 from below. In addition, a lock retaining arm 25B protrudes from a one-side edge portion of the first fan-shaped protruding piece 25A, the one-side edge portion being at a side close to the active operation arm 25C, so as to be positioned at a front side relative to the open link 19, and as illustrated in FIG. 9, a posture restriction protruding portion 25T (which corresponds to "a link operation position determination portion" according to the present invention) protrudes from a distal end portion of the lock retaining arm 25B towards the open link 19.

As illustrated in FIG. 15, a lock switch operation portion 106 (see FIG. 4) provided at a vehicle inner side of the door 101 is connected to a lower end portion of the second fan-shaped protruding piece 25D via a wire W2. By operating the lock switch operation portion 106, the active lever 25 can be switched to the unlock position and to the lock position.

In addition, as illustrated in FIG. 13, at the third component support wall 90E, a support hole 11J is formed below the open lever support shaft portion 20J, and a support sleeve 11T protrudes from an opening edge of the support hole 11J at a reverse surface of the third component support wall 90E. A first lever 32A projects towards a lateral side from one end portion of a relay shaft 32 passing through inside the support sleeve 11T and illustrated in FIG. 1, the one end portion being positioned within the second component accommodation portion 90B. The first lever 32A and the second fan-shaped protruding piece 25D are connected to each other with a relay link 30. In addition, a second lever 32B projects towards a lateral side from the other end portion of the relay shaft 32, and the second lever 32B and a key cylinder 102 (see FIG. 3) provided at the door 101 are connected to each other via a rod which is not shown. Then, also by inserting a key 103 (see FIG. 3) into the key cylinder 102 and then operating, the active lever 25 can be switched to the unlock position and to the lock position.

In a case where the active lever 25 is arranged at the unlock position in a state where the outside handle interlock lever 17 is arranged at the original position, the open link 19 is positioned at an unlock waiting position which is at an intermediate in a tiltable range thereof due to the contact of the active operation arm 25C of the active lever 25 and the lock-release piece 19B of the open link 19 with each other, and the push-up protruding piece 19C of the open link 19 is positioned below a distal end contact portion 16B of the lift lever 16 as illustrated in FIG. 10B. At this time, the posture restriction protruding portion 25T of the lock retaining arm 25B (see FIG. 9) is arranged dislocated relative to the sliding-contact protruding piece 19E of the open link 19 in a direction of the tilt axis (an axial direction of the imaginary axis passing through the center of the tilt connection hole 17B) of the open link 19, and a lock retaining arm main body 25S of the lock retaining arm 25B opposes the sliding-contact protruding piece 19E of the open link 19 from a front side. The lock retaining arm main body 25S corresponds to the lock retaining arm 25B excluding the posture restriction protruding portion 25T. In this state, when the outside door handle 104 or the inside door handle 105 is operated and thus the outside handle interlock lever 17 rotates from the original position to the operation position-side, the open link 19 moves upwardly, and consequently the open link 19 comes to tilt forward relative to the outside handle interlock lever 17. Then, as the open link 19 moves further upwardly, the lock-release piece 19B of the open link 19 moves away from the active operation arm 25C of the active lever 25, and as illustrated in FIG. 11B, the open link 19 moves upwardly in a state where the open link 19 is positioned at the start position of the tiltable range, which corresponds to the unlock position according to the present invention, due to the contact of the sliding-contact guide portion 92G and the upper end sliding-contact portion 19H with each other, and the push-up protruding piece 19C of the open link 19 pushes up the latch release portion 16B of the lift lever 16. Accordingly, the lift lever 16 rotates from an original position to a release position together with the ratchet 14 (see FIG. 6), the latch rotation restriction piece 14A of the ratchet 14 moves towards a lower side in this figure, the engagement between the ratchet 14 and the latch 13 is released, and consequently the door 101 can be opened. In addition, because the lock retaining arm main body 25S of the active lever 25 is positioned outside an operating region of the open link 19 when the open link 19 pushes up the latch release portion 16B of the lift lever 16 and thus unlatches, the open link 19 is not restricted from tilting by the lock retaining arm main body 25S of the active lever 25.

On the other hand, when the active lever 25 is arranged at the lock position in a state where the outside handle interlock lever 17 is arranged at the original position, as illustrated in FIG. 10A, the open link 19 is positioned at a lock waiting position which is at an end position-side relative to the above-described unlock waiting position in the liftable range thereof and the push-up protruding piece 19C of the open link 19 is positioned dislocated rearward from a lower position of the distal end contact portion 16B of the lift lever 16 due to the contact of the active operation arm 25C of the active lever 25 and the lock-release piece 19B of the open link 19 with each other. In addition, the posture restriction protruding portion 25T of the lock retaining arm 25B opposes the sliding-contact protruding piece 19E of the open link 19 from the front side. In this state, when the outside door handle 104 or the inside door handle 105 is operated and thus the outside handle interlock lever 17 rotates from the original position to the operation position-side, the open link 19 moves upwardly, and consequently the open link 19 comes to tilt forward relative to the outside handle interlock lever 17. However, in the middle of the tilting, the posture restriction protruding portion 25T makes contact with the sliding-contact protruding piece 19E of the open link 19, and the open link 19 does not tilt to the unlock position even though the lock-release piece 19B of the open link 19 moves away from the active operation arm 25C of the active lever 25. In a state where the open link 19 is kept in the lock position which is at the end position-side relative to the unlock position without tilting to the unlocked position, the open link 19 moves upwardly while allowing the sliding-contact protruding piece 19E and the posture restriction protruding portion 25T to sliding-contact with each other. Then, as illustrated in FIG. 11A, the push-up protruding piece 19C of the open link 19 passes through a lateral side of the lift lever 16, and thus the latch release portion 16B of the lift lever 16 is not pushed up by the open link 19, and consequently the latching of the door 101 by the latch mechanism 1 OR is maintained.

Figure 18:
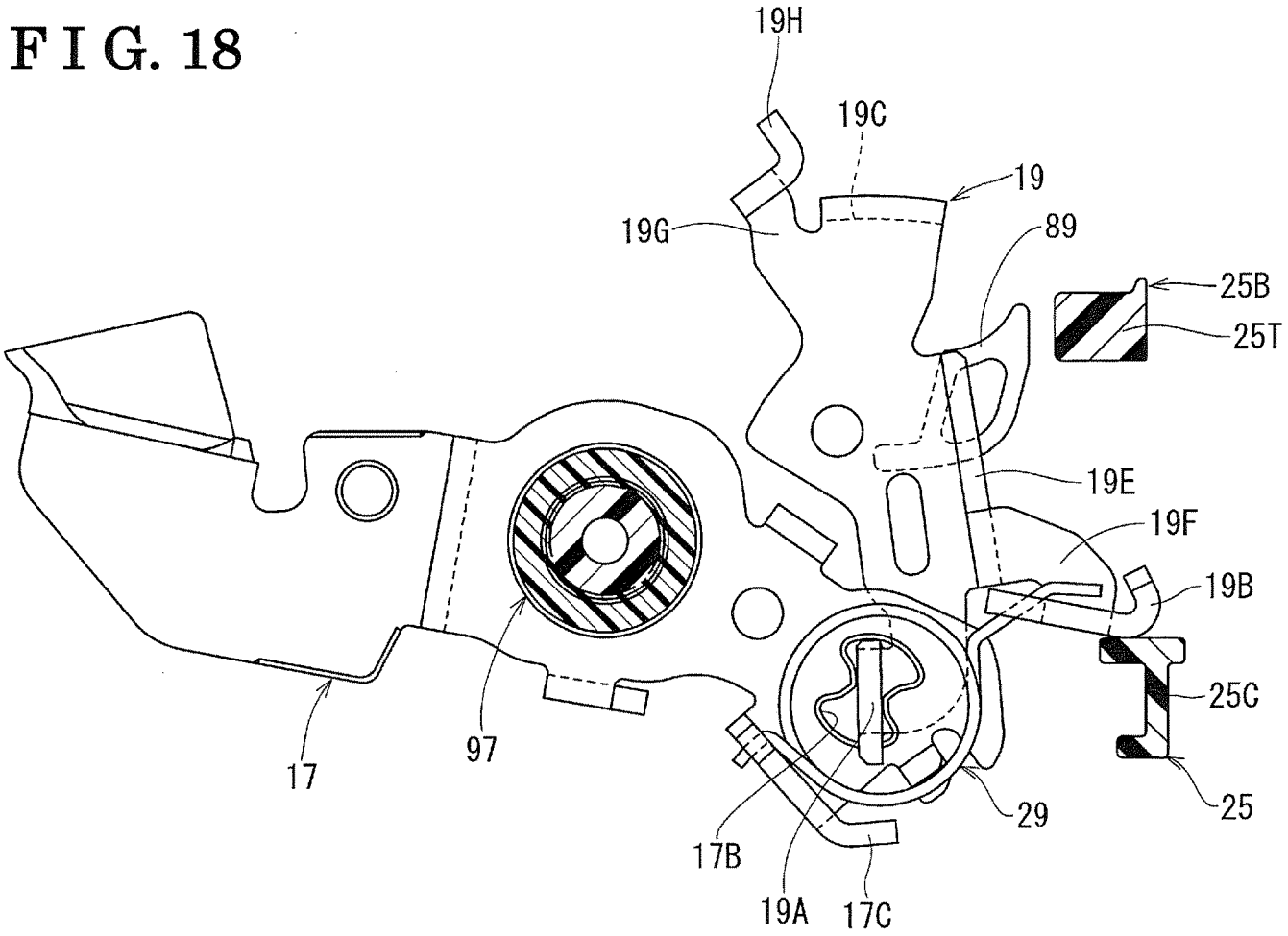
Figure 19:
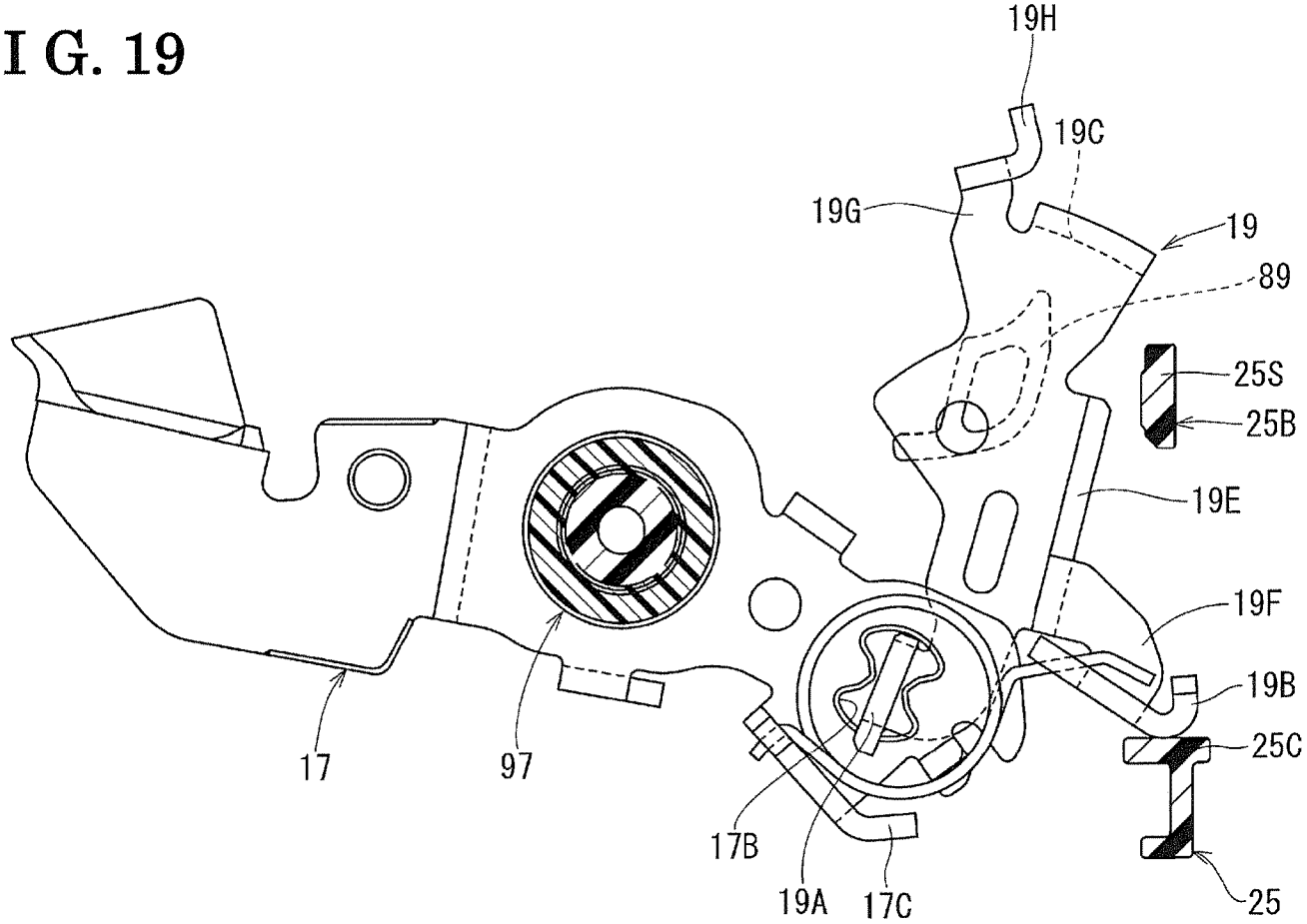

As illustrated in FIG. 17, a lateral inclination restriction protruding portion 89 according to the present invention is protrudingly formed at the first component support wall 11C. As illustrated in FIG. 12, the lateral inclination restriction protruding portion 89 is formed in a cylindrical configuration having a deformed cross section, and a distal end is formed to include a flat surface. As illustrated in FIG. 17, FIG. 18 and FIG. 19, the lateral inclination restriction protruding portion 89 is applied to the open link 19, to a position close to an upper end, and restricts the open link 19 from inclining towards the first component support wall 11C.

Figure 20:
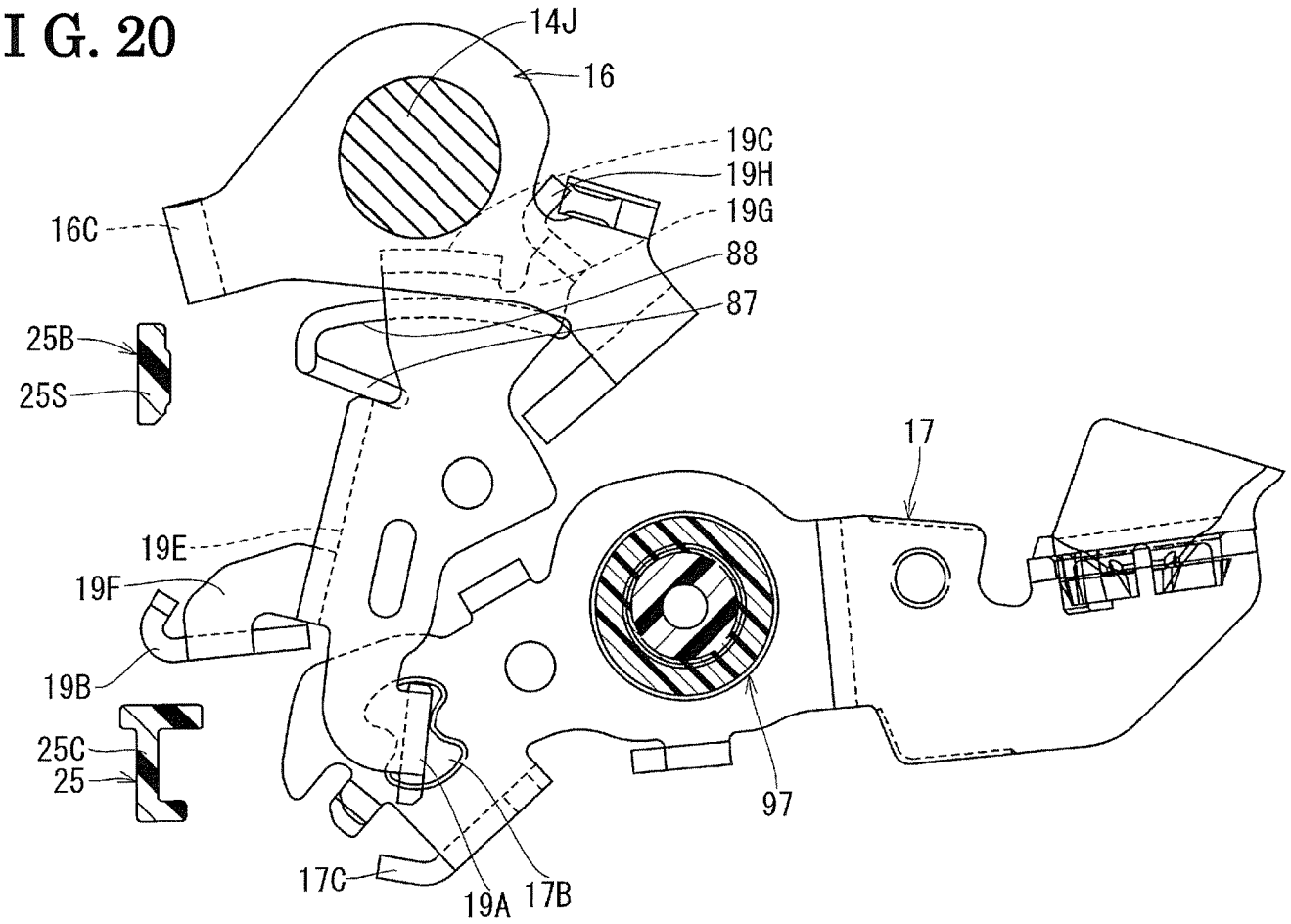
Figure 21:
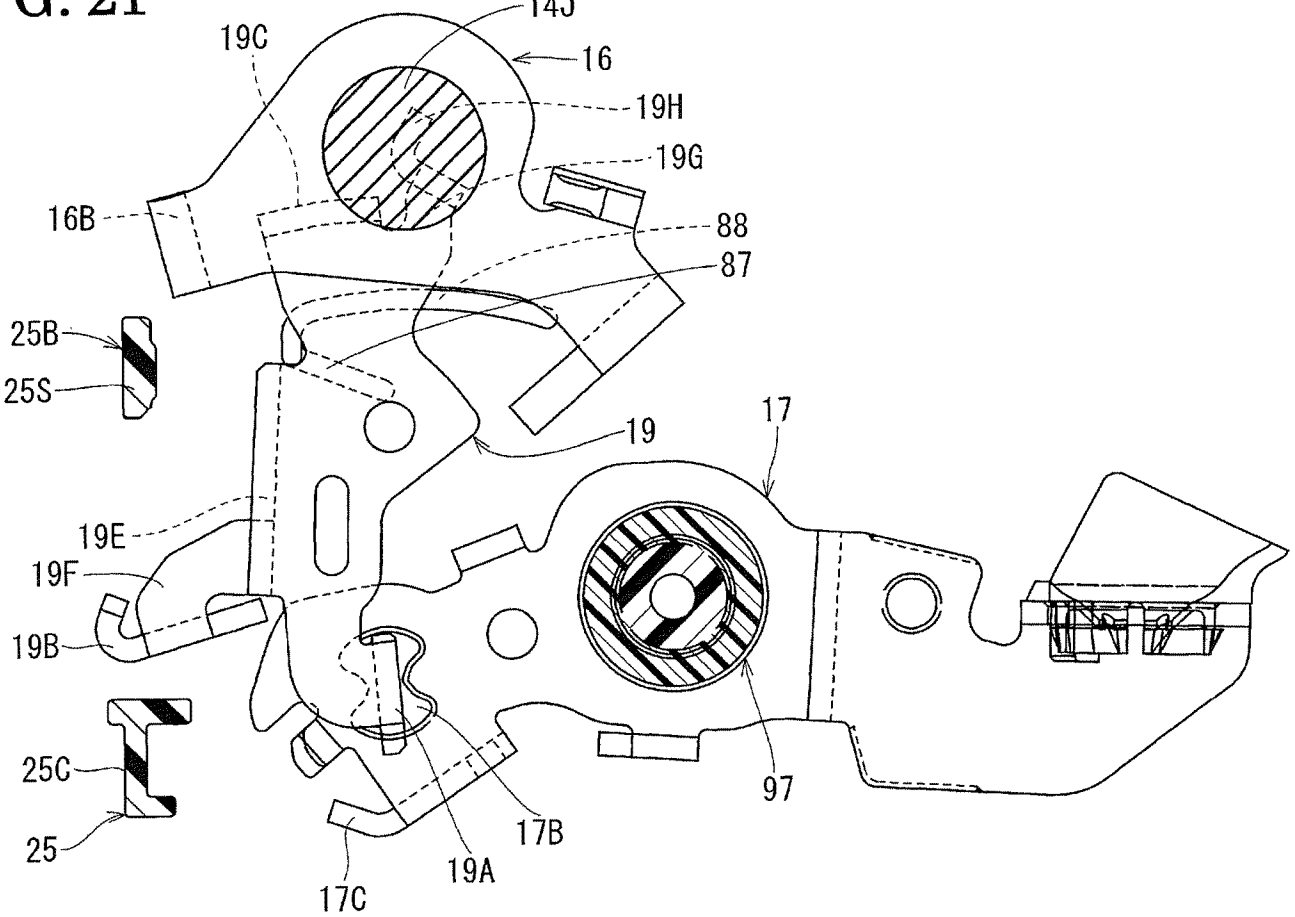

In addition, as illustrated in FIG. 13, an inside protruding wall 85 which protrudes towards the second component accommodation portion 90B to be parallel to the second component support wall 90C is provided at a corner portion of the support main body 90 at which the second component support wall 90C and the third component support wall 90E intersect with each other. Then, a lateral inclination restriction protruding portion 88 according to the present invention is protrudingly formed at the inside protruding wall 85. The lateral inclination restriction protruding portion 88 includes a rib structure and extends from a base end portion to a distal end portion of the inside protruding wall 85 to be curved to expand to an upper side slightly while being curved downwardly at the distal end-side of the inside protruding wall 85. Then, as illustrated in FIG. 17, FIG. 20 and FIG. 21, the lateral inclination restriction protruding portion 88 is applied to the open link 19, at a position close to the upper end of the open link 19 relative to the lateral inclination restriction protruding portion 89 and restricts the open link 19 from inclining towards the second component support wall 90C.

As illustrated in FIG. 13, also a sliding-contact tilt guide 87 according to the present invention is protrudingly formed at the inside protruding wall 85, and the sliding-contact tilt guide 87 and the lateral inclination restriction protruding portion 88 are integral with each other. Specifically, the sliding-contact tilt guide 87 is extended linearly from a lower end portion of a downwardly-curved portion of the lateral inclination restriction protruding portion 88 at the distal end-side of the inside protruding wall 85 in a manner that the sliding-contact tilt guide 87 is inclined obliquely downwardly towards the base end portion of the inside protruding wall 85. In addition, amount of protrusion of the sliding-contact tilt guide 87 from the inside protruding wall 85 is smaller than the lateral inclination restriction protruding portion 88, and a rear end portion of the sliding-contact tilt guide 87 is positioned at an intermediate portion in an entire length of the whole of the lateral inclination restriction protruding portion 88 in a horizontal direction. Further, a part of the above-described reinforcing ribs 84 is extended to a position at which the reinforcing rib 84 is connected to a lower surface of the lateral inclination restriction protruding portion 88 and the rear end portion of the sliding-contact tilt guide 87 is abutted with the reinforcing rib 84. In addition, the sliding-contact tilt guide 87 protrudes more largely than the reinforcing ribs 84 towards the open link 19.

Normally, the sliding-contact tilt guide 87 does not interfere with the open link 19, however, when there is a malfunction in which the open link 19 cannot move from the lock waiting position to the lock position, the sliding-contact tilt guide 87 makes sliding-contact with the sliding-contact protruding piece 19E of the open link 19. Specifically, for example, the following malfunction can be considered; in a state where the active lever 25 is arranged at the lock position, and as illustrated in FIG. 10A, when the outside handle interlock lever 17 is arranged at the original position and the open link 19 is positioned at the lock waiting position, dust or the like comes into the tilt connection hole 17B, and accordingly the open link 19 is kept at the lock waiting position and does not tilt from the lock waiting position to the unlock waiting position even though the active lever 25 is moved to the unlock position. In such an abnormal state, when the outside handle interlock lever 17 moves from the original position to the operation position, an upper end portion of the sliding-contact protruding piece 19E of the open link 19 makes contact with the sliding-contact tilt guide 87 as illustrated in FIG. 20. Then, by a handle operation force of the outside door handle 104 or the inside door handle 105 which is applied to the outside handle interlock lever 17, the upper end portion of the sliding-contact protruding piece 19E is pushed against the sliding-contact tilt guide 87 and makes sliding-contact with the sliding-contact tilt guide 87. Then, as illustrated in FIG. 21, the open link 19 is forcibly tilted from the lock waiting position towards the lock position. Accordingly, elimination of the dust or the like from the tilt connection hole 17B is promoted, and the tilt malfunction of the open link 19 can be removed. In addition, during the handle operation at this time, the latching of the door 101 (see FIG. 3) by the latch mechanism 10R (see FIG. 5) is not released because the push-up protruding piece 19C of the open link 19 passes through a lateral side of the latch release portion 16B of the lift lever 16. However, the open link 19 moves to the unlock waiting position when the outside handle interlock lever 17 returns to the original position because the tilt malfunction of the open link 19 due to the dust or the like has been eliminated. Accordingly, in a case where the handle operation is performed again at the outside door handle 104 or the like and thus the outside handle interlock lever 17 moves to the operation position, the open link 19 moves to the unlock position and the push-up protruding piece 19C pushes up the latch release portion 16B of the lift lever 16. Consequently, the latching of the door 101 by the latch mechanism 1 OR can be released.

In a normal state, the open link 19 tilts from the lock waiting position to the lock position that is at a front side relative thereto during the movement of the outside handle interlock lever 17 to the operation position from a state where the active lever 25 is arranged at the lock position and the upper end portion of the sliding-contact protruding piece 19E confronts the sliding-contact tilt guide 87 from below while a clearance gap is provided therebetween as illustrated in FIG. 10A. Thus, the outside handle interlock lever 17 can be moved to the operation position without causing the sliding-contact protruding piece 19E to interfere with the sliding-contact tilt guide 87 as illustrated in FIG. 11A.

As described above, the door lock device 10 of the present embodiment is configured in such a manner that the open link 19 is pushed by a biasing force of the torsion coil spring 29 against the active operation arm 25C or the posture restriction protruding portion 25T, and is positioned thereat, and accordingly a degree of freedom in disposition of the open link 19 is higher compared to a known case where an open link is connected to another component by means of a pin and an elongated hole. Thus, the door lock device 10 can be made compact. In addition, at the malfunction in which the open link 19 does not move from the lock waiting position due to jamming by inclusion of the dust or the like, the sliding-contact tilt guide 87 provided at the support body 11 makes sliding-contact with the open link 19 and forcibly causes the open link 19 to tilt to promote the elimination of the dust or the like when the outside handle interlock lever 17 rotates, thereby eliminating the malfunction. Therefore, there is no need to increase the energizing force of the torsion coil spring 29 as a precaution against the above-described malfunction. Consequently, an operational resistance when the door lock device 10 is put into the locked state can be reduced.

In addition, the lateral inclination restriction protruding portion 89 and the lateral inclination restriction protruding portion 88 which are provided at the support body 11 restrict the open link 19 from inclining laterally, and an operational resistance of the open link 19 is prevented from increasing. This can also reduce the biasing force of the torsion coil spring 29 and reduce the operational resistance when the door lock device 10 is put into the locked state. In addition, the sliding-contact protruding piece 19E of the open link 19 is used for dual purposes as a portion to which the posture restriction protruding portion 25T contacts and also as a portion at which the sliding-contact protruding piece 19E makes sliding-contact with the sliding-contact tilt guide 87, and thus the open link 19 includes a simple structure.

In addition, the door lock device 10 of the present embodiment provides the following effects in terms of durability. That is, the plural support shaft portion reinforcing ribs 95T are protrudingly formed at the first component support wall 11C, at a peripheral portion of a reverse side of the open lever rotation support shaft portion 97 supporting the outside handle interlock lever 17 in a manner that the outside handle interlock lever 17 is rotatable, and thus strength of the first component support wall 11C at a rising portion of the open lever rotation support shaft portion 97 is increased, and thus the durability against load applied to the open lever rotation support shaft portion 97 is enhanced. Accordingly, the entire open lever rotation support shaft portion 97 can be prevented from inclining, and a rotation resistance of the outside handle interlock lever 17 is prevented from increasing and abnormal noises can be prevented from occurring. In addition, because the plural support shaft portion reinforcing ribs 95T are extended in the radial manner, the durability against the load can be enhanced in both up/down direction and horizontal direction at the rising portion of the open lever rotation support shaft portion 97 of the first component support wall 11C. Due to the reinforcement of the protruding portion support wall 95J which is achieved by the support shaft portion reinforcing ribs 95T, a durability-and-strength of the protruding portion support wall 95J against an impact force from a vehicle lateral surface can be increased.

Further, in addition to supporting the outside handle interlock lever 17, the open lever rotation support shaft portion 97 is used also for supporting the torsion coil spring 18 for the handle interlock lever and for supporting the latch-holding torsion coil spring 14S, and thus the door lock device 10 includes a compact structure compared to a case where they are supported separately from one another. In addition, the coil portion 14K of the latch-holding torsion coil spring 14S is surrounded from the outer side by the surrounding wall 95F formed protrudingly at the first component support wall 11C, and thus the coil portion 14K is supported in a stabilized manner.

In addition, the open lever rotation support shaft portion 97 includes a both end supported beam structure between the first component support wall 11C and the second component support wall 90C, and thus includes a high strength. In addition, the annular protrusion 83 surrounding the entire support cylinder portion 96, which constitutes the open lever rotation support shaft portion 97, from a lateral side is provided at the second component support wall 90C, and the opening edge of the through hole 17F of the outside handle interlock lever 17 is applied to the annular protrusion 83. Accordingly, even in a case where burrs remain at an edge portion of the through hole 17F, the burrs are received in an annular gap between the annular protrusion 83 and the support cylinder portion 96, and the outside handle interlock lever 17 rotates smoothly.

Further, the support cylinder portion 96 is cut obliquely to include the distal end sloped surface 96S, and thus the small diameter shaft portion 95C of the support protruding portion 95 can be inserted into the support cylinder portion 96 gradually, thereby facilitating the insertion operation. In addition, the reinforcing ribs 84 extending from the annular protrusion 83 in the radial manner are provided at the second component support wall 90C, and thus strength of the entire second component support wall 90C is increased and durability against a load applied to the support cylinder portion 96 is enhanced. This can also prevent the rotation resistance of the outside handle interlock lever 17 from increasing and prevent the abnormal noises from occurring.

Second Embodiment

Figure 27:
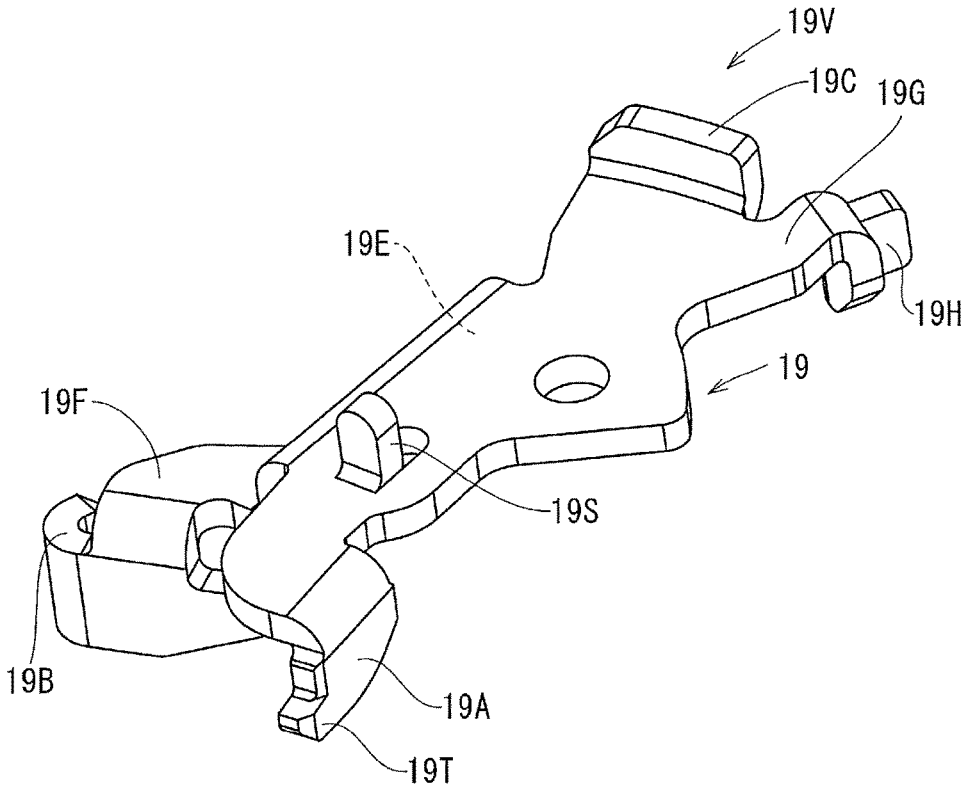
FIG. 27 Perspective view of an open link of a second embodiment
Figure 28:
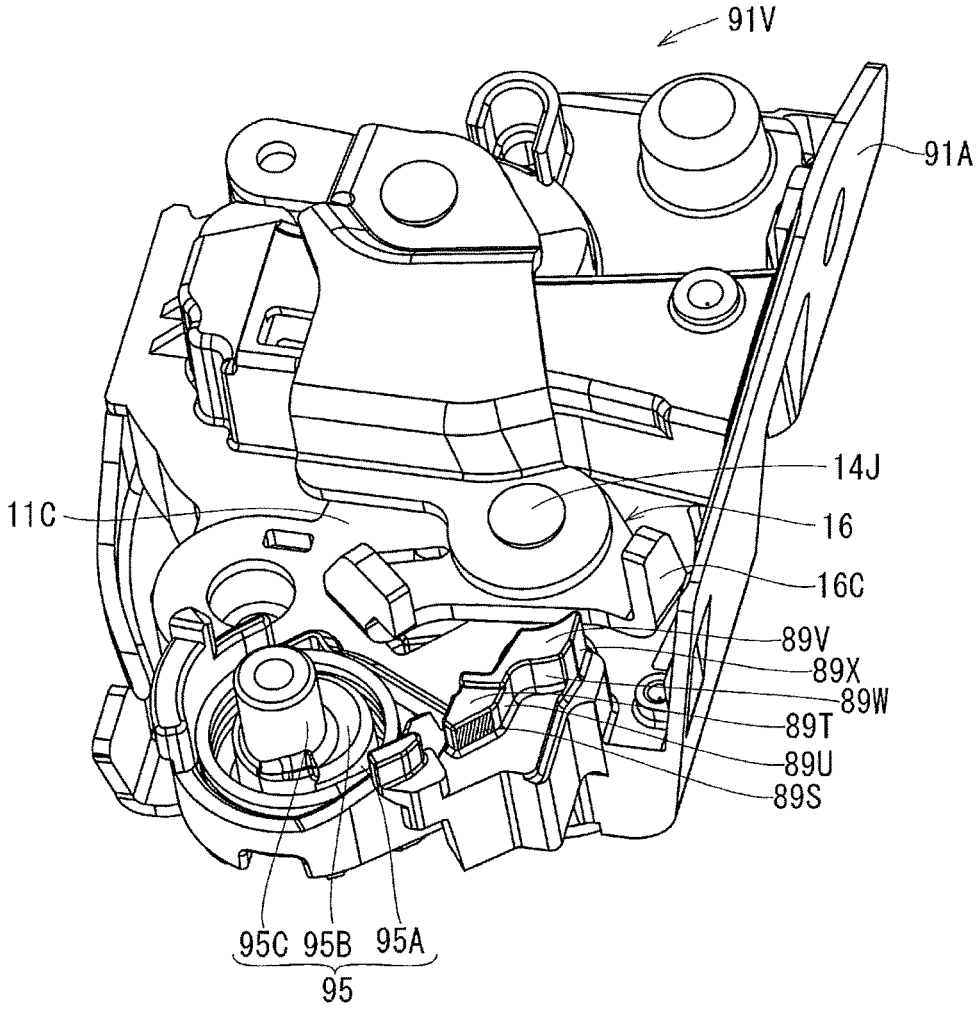
FIG. 28 Perspective view of an inner side of a first cover

The present embodiment is illustrated from FIG. 27 to FIG. 31, and is different from the first embodiment in that a sliding-contact protrusion 19S (see FIG. 27) is formed to protrude from an open link 19V towards the first component support wall 11C and a sliding-contact tilt guide 89T (see FIG. 28) which corresponds to the sliding-contact protrusion 19S is provided at a first cover 91V. Specifically, as illustrated in FIG. 27, the sliding-contact protrusion 19S is formed in a manner that a portion of the open link 19V at a position close to a lower end is cut off in a shape of a projecting piece and is bent at the right angle towards the first component support wall 11C. On the other hand, the sliding-contact tilt guide 89T protrudes from the first component support wall 11C of the first cover 91V and is integral with a lower surface of a lateral inclination restriction protruding portion 89V as illustrated in FIG. 28. In addition, amount of protrusion of the sliding-contact tilt guide 89T from the first component support wall 11C is slightly smaller than the lateral inclination restriction protruding portion 89V.

Figure 29:
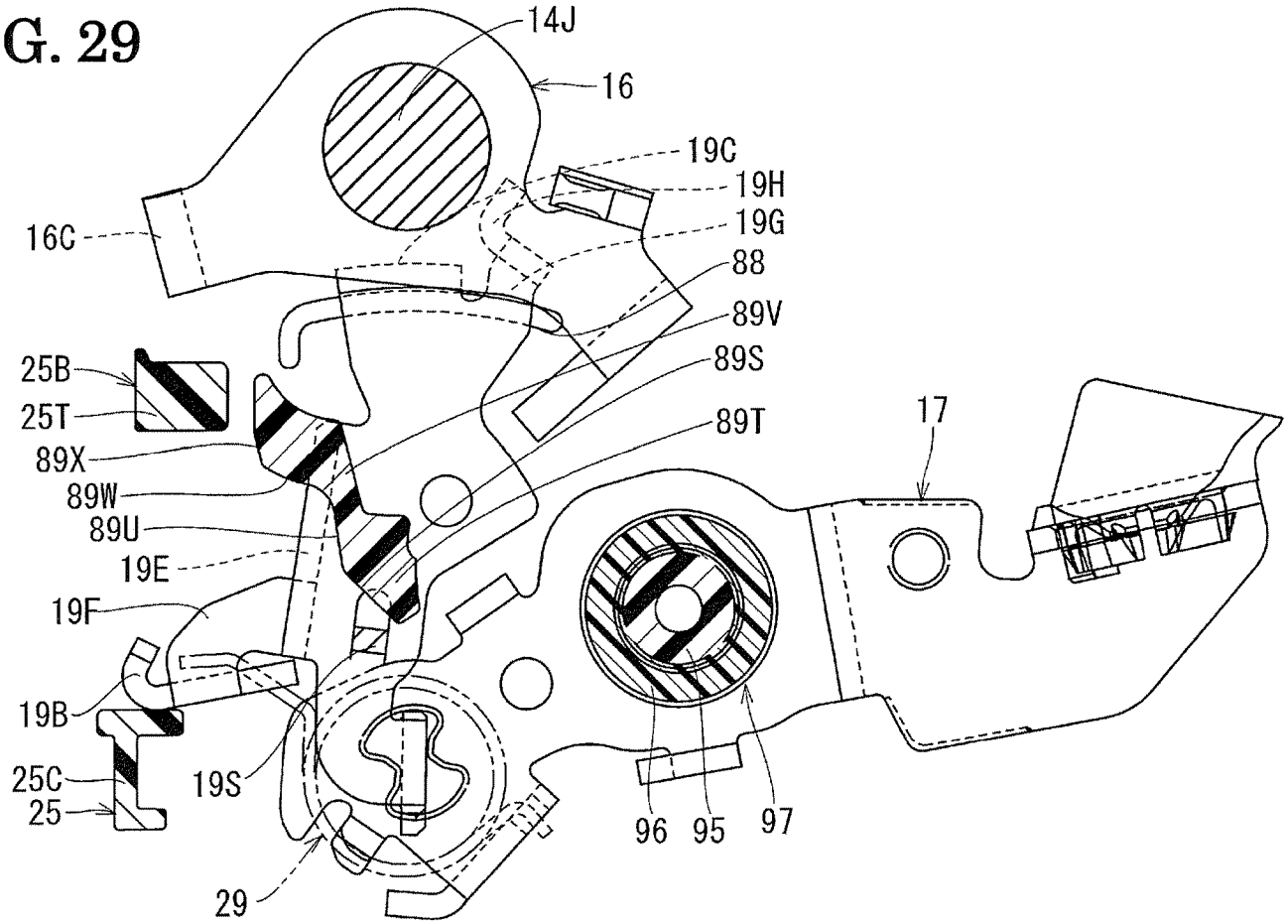
FIG. 29 Side view of a handle interlock lever and the open link

In addition, a first sloped surface 89S and a second sloped surface 89U are provided at the sliding-contact tilt guide 89T, at a side surface facing opposite to the open lever rotation support shaft portion 97 as illustrated in FIG. 29. The first sloped surface 89S is inclined from a lower end of the sliding-contact tilt guide 89T upwardly to be away from the open lever rotation support shaft portion 97. The second sloped surface 89U is extended, at an inclination angle that is closer to perpendicular than the first sloped surface 89S, from an upper end portion of the first sloped surface 89S in an obliquely upward direction to a position that reaches the lateral inclination restriction protruding portion 89V. Further, the lateral inclination restriction protruding portion 89V is provided with a third sloped surface 89W extended from an upper end portion of the second sloped surface 89U in an obliquely upward direction at an inclination angle that is closer to horizontal than the second sloped surface 89U and a fourth sloped surface 89X extended from an upper end portion of the third sloped surface 89W in an obliquely upward direction to an upper end of the lateral inclination restriction protruding portion 89V at an inclination angle that is closer to perpendicular than the third sloped surface 89W.

In the present embodiment, the sliding-contact tilt guide 87 described in the first embodiment is not provide at the main body 90 because the sliding-contact tilt guide 89T is provided at the first cover 91V. In addition, the configurations other than the above-described portions are similar to the first embodiment, and therefore the same reference numerals designate the same portions and duplicated description will be omitted.

Next, operation and effect of the present embodiment will be described. According to the above-described configuration of the present embodiment, as illustrated in FIG. 29, in a state where the outside handle interlock lever 17 is arranged at the original position, when the open link 19V is arranged at the lock waiting position, the sliding-contact protrusion 19S is positioned below the first sloped surface 89S of the sliding-contact tilt guide 89T to be apart therefrom. In a normal state, when the outside handle interlock lever 17 is moved from the original position to the operation position, the open link 19V is tilted by the resilient force of the torsion coil spring 29 to the lock position, and accordingly the sliding-contact protrusion 19S moves upwardly without making contact with the sliding-contact tilt guide 89T and the lateral inclination restriction protruding portion 89V. Eventually, the push-up protruding piece 19C of the open link 19V pushes up the latch release portion 16B of the lift lever 16, thereby releasing the latching of the door 101 which is latched by the latch mechanism 10R (see FIG. 5).

Figure 30:
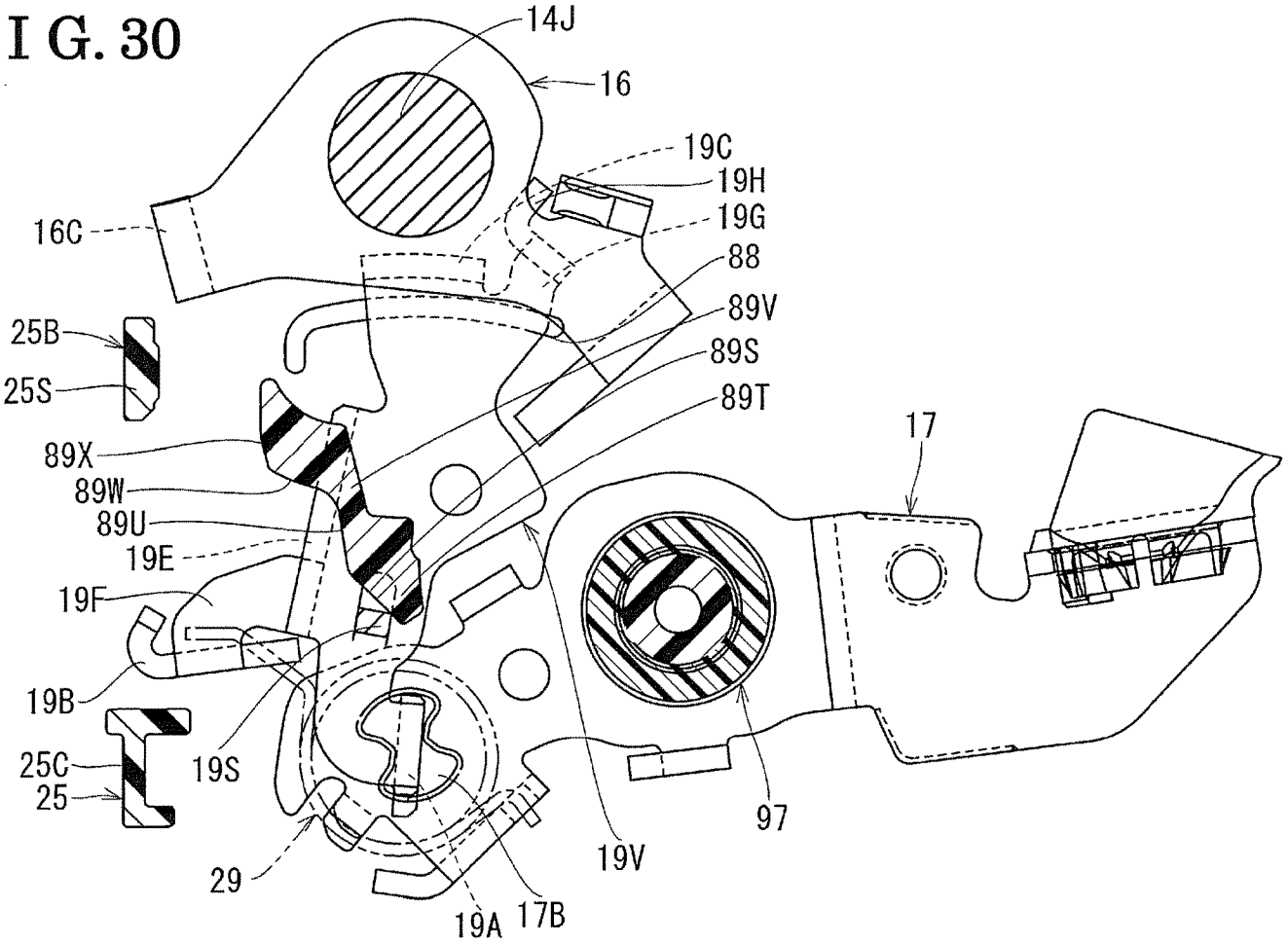
FIG. 30 Side view of the handle interlock lever and the open link
Figure 31:
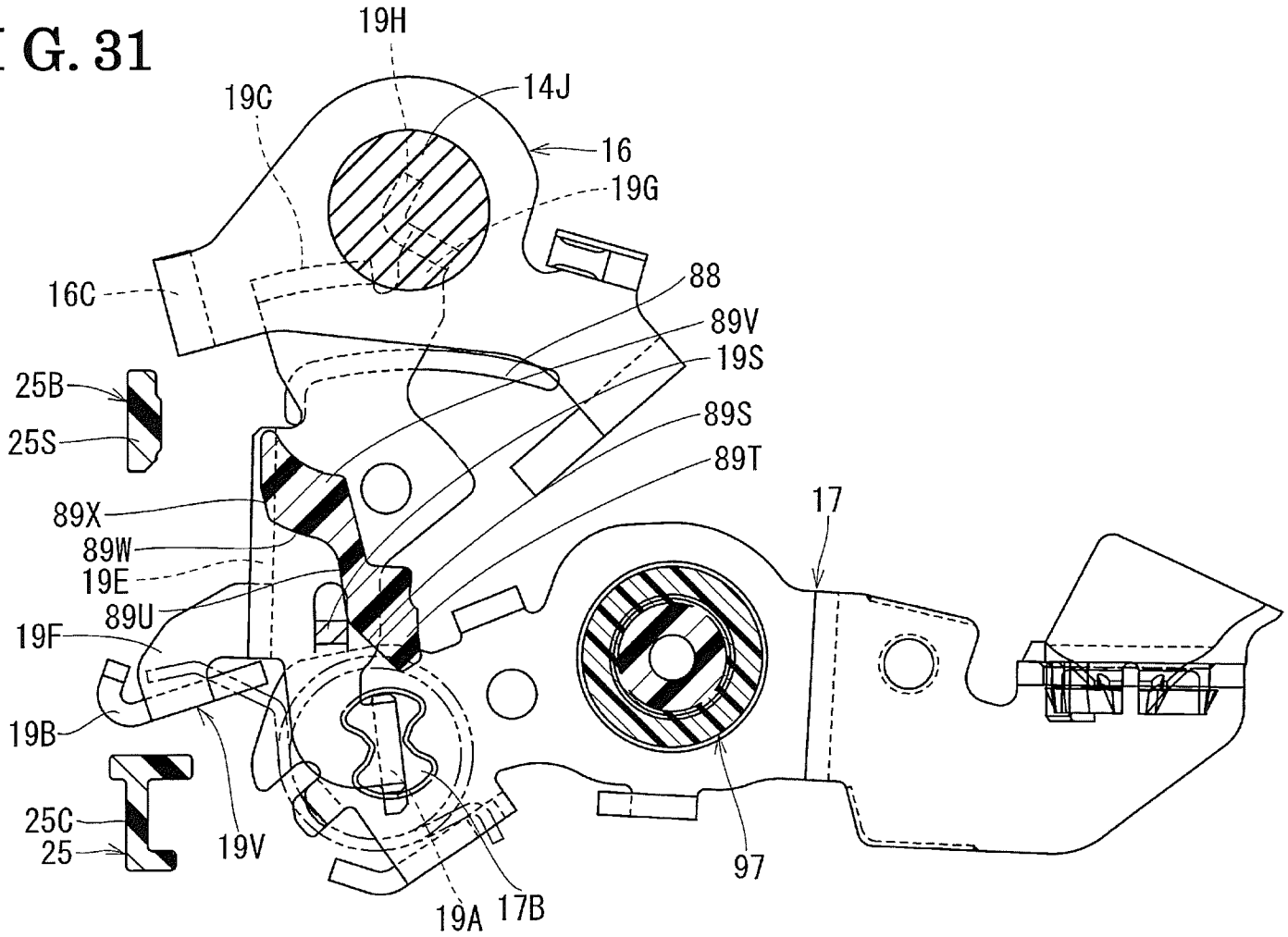
FIG. 31 Side view of the handle interlock lever and the open link

At the malfunction caused by, for example, the dust or the like in which the open link 19V does not tilt and the open link 19V is kept at the lock waiting position even though the active lever 25 is switched from the lock position to the unlock position, the sliding-contact protrusion 19S of the open link 19V makes sliding-contact with the first sloped surface 89S of the sliding-contact tilt guide 89T and the open link 19V is forcibly made to tilt towards the lock position as illustrated in FIG. 30 and FIG. 31 when the outside handle interlock lever 17 is moved from the original position to the operation position. Accordingly, the tilt malfunction of the open link 19V caused by the dust or the like is eliminated in a similar manner to the first embodiment. If the above-described malfunction is still not eliminated, the sliding-contact protrusion 19S further makes sliding-contact with the second sloped surface 89U, the third sloped surface 89W and the fourth sloped surface 89X, and thus the open link 19V is forcibly tilted.

Other Embodiment

The present invention is not limited to the above-described embodiments and may be modified and implemented in various ways within a range that does not depart from the principles.

(1) In the above-described embodiment, the start position of the tiltable range of the open link 19 corresponds to the unlock position, however, a position dislocated from the start position of the tiltable range may be the unlock position, and the open link 19 may be adapted to be in sliding-contact with the lock retaining arm 25B and be arranged at the unlock position.

(2) The above-described embodiment is configured in such a manner that, in a case where the outside handle interlock lever 17 is positioned at the original position in the unlocked state, the open link 19 is positioned at the unlock waiting position which is at the end position-side relative to the unlock position, and the open link 19 tilts from an unlock waiting state to the unlock position which is at the start position-side in the course of the movement of the outside handle interlock lever 17 to the operation position, however, it may be configured in such a manner that, in the unlocked state, the open link 19 is always kept at a constant unlock position (for example, the start position of the tiltable range) regardless of the position of the outside handle interlock lever 17. In addition, it may be configured in such a manner that the unlock waiting position is set at the start position-side relative to the unlock position, and the open link 19 makes sliding-contact with the posture restriction protruding portion 25T and tilts from the unlock waiting state to the unlock position which is at the end position-side in the course of the movement of the outside handle interlock lever 17 from the original position to the operation position.

(3) The above-described embodiment is structured in such a manner that, in a case where the open link 19 is in a laterally-inclined state, the lateral inclination restriction protruding portion 88 is in contact with a side surface of the open link 19 and the sliding-contact tilt guide 87 is not in contact with the side surface of the open link 19, however, the sliding-contact tilt guide 87 may be configured to be in contact with the side surface of the open link 19 in the laterally-inclined state so that the sliding-contact tilt guide 87 serves also as a lateral inclination restriction auxiliary protruding portion or the lateral inclination restriction protruding portion according to the present invention.

(4) In the above-described embodiments, the sliding-contact tilt guides (87, 89T) are formed at the support body 11 (specifically at the main body 90 or the first cover 91V), however, the sliding-contact tilt guide may be constituted by a protruding piece protruding from a lateral side of the inner surface reinforcing board.

Figure 32:
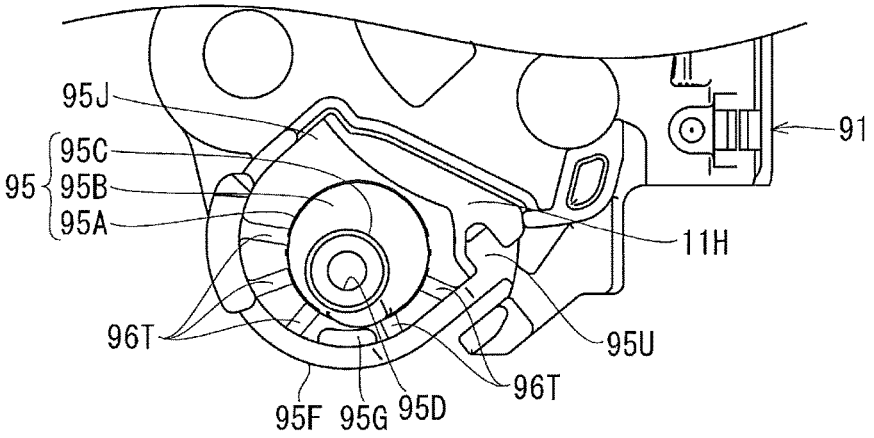
FIG. 32 Front view of an inner side of a first cover according to a variation of the present invention FIG. 33 Cross-sectional view of a door lock device according to a variation of the present invention FIG. 34 Front view of main components of a known door lock device

(5) In the above-described embodiments, the above-described support shaft portion reinforcing ribs 95T are formed at the outer surface of the protruding portion support wall 95J, however, for example, as illustrated in FIG. 32, support shaft portion reinforcing ribs 96T according to the present invention may be formed at an inner surface of the protruding portion support wall 95J.

(6) In the above-described embodiments, the plural support shaft portion reinforcing ribs 95T are extended in the radial manner, however, the plural support shaft portion reinforcing ribs 95T may be extended in the up/down direction or may be extended in the horizontal direction, or alternatively, may be formed to include a grid configuration.

Figure 33:
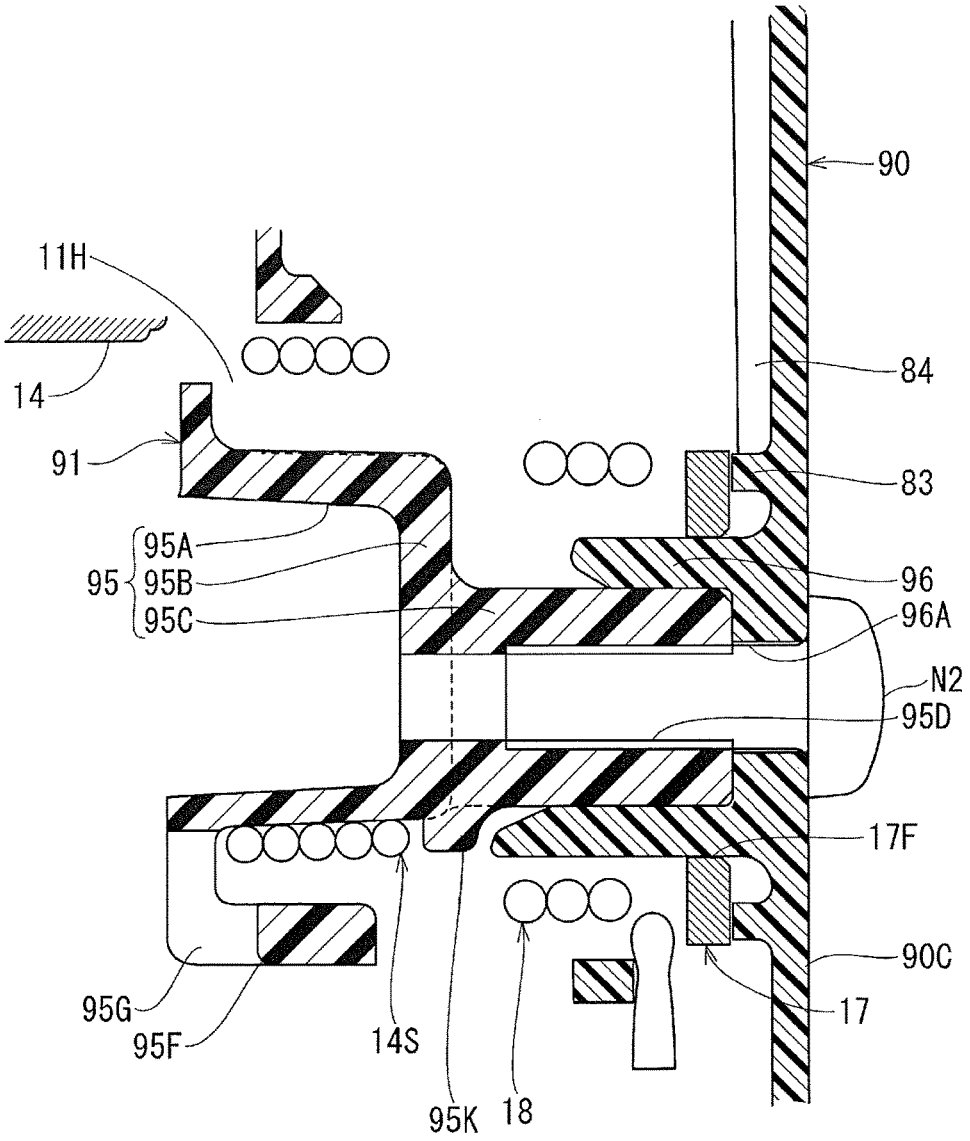
Figure 34:
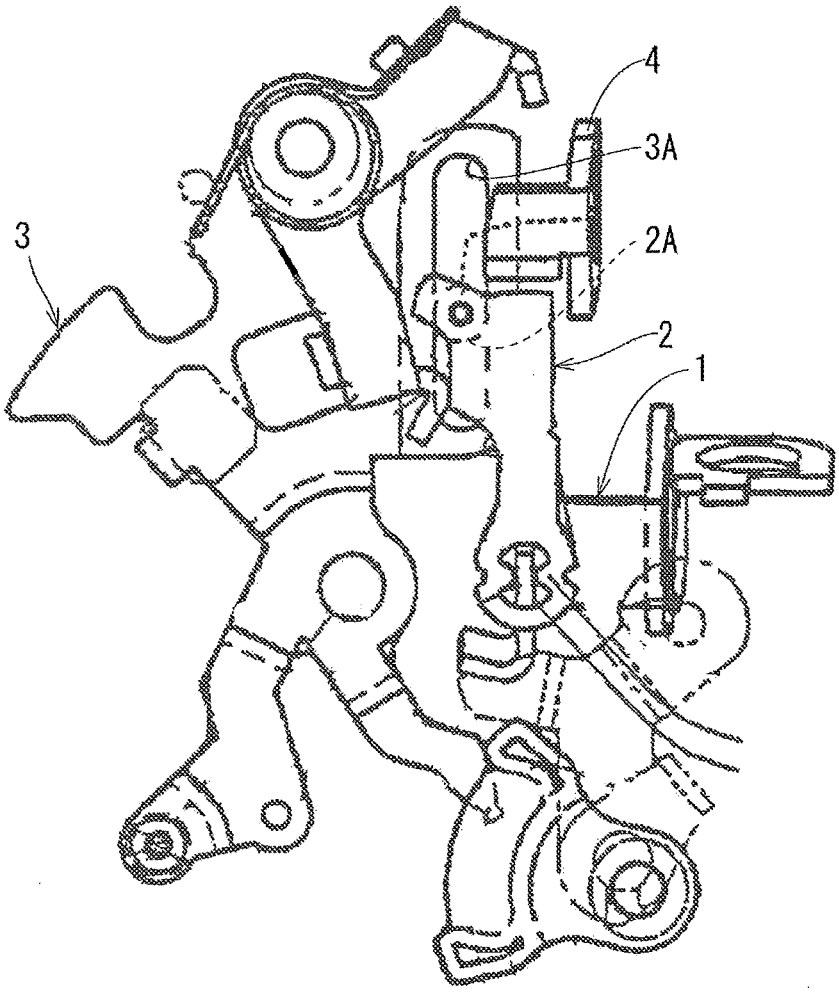

(7) In the above-described embodiments, the coil contact protrusion 95E is formed so that the coil portion 14K of the latch-holding torsion coil spring 14S is not dislocated in the axial direction of the large diameter shaft portion 95A due to the draft angle of the large diameter shaft portion 95A. However, for example, as illustrated in FIG. 33, a lock protrusion 95K protruding downwardly from a border portion between the large diameter shaft portion 95A and the small diameter shaft portion 95C of the support protruding portion 95, and locking at the coil portion 14K to prevent the coil portion 14K of the latch-holding torsion coil spring 14S from being coming off the large diameter shaft portion 95A may be provided.

(8) The open lever rotation support shaft portion 97 of the above-described embodiments includes the both end supported beam structure in which both end portions are supported by the first component support wall 11C and the second component support wall 90C, however, the open lever rotation support shaft portion 97 may protrude from the first component support wall 11C to include a cantilever beam configuration.

EXPLANATION OF REFERENCE NUMERALS

10 door lock device
10R latch mechanism
11 support body
11C first component support wall (component support wall)
13 latch
14 ratchet
14K coil portion
14S latch-holding torsion coil spring
17F through hole
16 lift lever
16B latch release portion
16Z lock switch mechanism
17 outside handle interlock lever (handle interlock lever)
19 open link
19E sliding-contact protruding piece
25C active operation arm (link waiting position determination portion)
25T posture restriction protruding portion (link operation position determination portion)
29 torsion coil spring (tilt biasing spring)
84 reinforcing rib (auxiliary wall reinforcing rib)
87, 89T sliding-contact tilt guide
88, 89, 89V lateral inclination restriction protruding portion
90C second component support wall (component support auxiliary wall)
95 support protruding portion
95E coil contact protrusion
95F surrounding wall
95J protruding portion support wall
95T, 96T support shaft portion reinforcing rib
96 support cylinder portion
96A through hole
95S sloped outer circumferential surface
96S distal end sloped surface
97 open lever rotation support shaft portion

The invention claimed is:

1. A door lock device comprising:

a latch mechanism adapted to latch a door of a vehicle in a closed state;

a handle interlock lever normally positioned at an original position and adapted to rotate to an operation position upon receiving an operation force relative to a door handle of the vehicle;

an open link tiltably connected to a position in the handle interlock lever which is away from a rotational center of the handle interlock lever, the open link being switchable between an unlocked state in which the open link is positioned at an unlock position at which the open link pushes a latch release portion included in the latch mechanism and unlatches the door when the handle interlock lever rotates to the operation position, and a locked state in which the open link is positioned at a lock position at which the open link passes a lateral side of the latch release portion and does not unlatch the door when the handle interlock lever rotates to the operation position;

a tilt biasing spring biasing the open link towards the unlock position;

an active lever comprising a link waiting position determination portion and a link operation position determination portion, the link waiting position determination portion positioning the open link at a lock waiting position when the handle interlock lever is arranged at the original position in the locked state, the link waiting position determination portion allowing the open link to be tilted towards the unlock position by a biasing of the tilt biasing spring in the middle of movement of the handle interlock lever from the original position to the operation position, the link operation position determination portion making contact with the open link in the middle of the movement of the handle interlock lever from the original position to the operation position in the locked state, preventing the open link from tilting to the unlock position, and keeping the open link at the lock position; and a sliding-contact tilt guide protruding from a housing wall of the door lock device to be slidingly-contacted by the open link to cause the open link to tilt in a direction opposite a direction of rotation of the handle interlock lever when the handle interlock lever rotates from the original position to the operation position in a state where the open link is maintained at the lock waiting position to eliminate a temporary malfunction of the open link and allow the open link to operate normally.

2. The door lock device according to claim 1, comprising:

a lateral inclination restriction protruding portion applied to one side surface or both side surfaces of the open link in a direction of a tilt axis of the open link and restricting the open link from inclining laterally.

3. The door lock device according to claim 2, comprising:

a tilt connection hole formed in a penetrating manner at one of the handle interlock lever and the open link at the connecting portion of the handle interlock lever and the open link;

a tilt connection protruding piece protruding from the other of the handle interlock lever and the open link at the connecting portion of the handle interlock lever and the open link, and including a distal end wide width portion at a distal end, the tilt connection protruding piece being inserted into the tilt connection hole in a state where the open link is in a laterally-inclined posture inclined towards one side, the tilt connection protruding piece being prevented from coming off by changing the open link to a normal posture, the tilt connection protruding piece connecting the open link to the handle interlock lever in a manner that the open link is tiltable; and the lateral inclination restriction protruding portion arranged at a position at which the lateral inclination restriction protruding portion restricts the open link from laterally inclining to the one side.

4. The door lock device according to claim 1, comprising:

a sliding-contact protruding piece including a shape of a protruding piece projecting from the open link in the direction of the tilt axis thereof, wherein the link operation position determination portion and the sliding-contact tilt guide are sliding-contactable with the sliding-contact protruding piece.

5. The door lock device according to claim 1, comprising:

a support body adapted to be fixed to the door, the latch mechanism being assembled on the support body;

the handle interlock lever rotatably supported at the support body; and the sliding-contact tilt guide formed at the support body.

6. The door lock device according to claim 5, comprising:

the support body on which the latch mechanism being assembled, the support body being made of resin;

a component support wall provided at the support body and adapted to be arranged to oppose a door end portion wall which is at a side opposite to a rotational center of the door;

a lever rotation support shaft portion protrudingly formed at the component support wall and being inserted into a through hole included in the handle interlock lever, the lever rotation support shaft portion supporting the handle interlock lever in a rotatable manner; and a support shaft portion reinforcing rib formed at a peripheral portion of the lever rotation support shaft portion of the component support wall or at a peripheral portion of a reverse side of the lever rotation support shaft portion of the component support wall.

7. The door lock device according to claim 6, comprising:

the support shaft portion reinforcing rib extended radially centered on the lever rotation support shaft portion.

8. The door lock device according claim 6 comprising:

a surrounding wall protrudingly formed at the component support wall and surrounding, from a lateral side, a circumferential part of an end portion of the lever rotation support shaft portion at a side of the component support wall;

a latch-holding torsion coil spring including a coil portion which is inserted at the end portion of the lever rotation support shaft portion at the side of the component support wall and is accommodated between the surrounding wall and the lever rotation support shaft portion, the latch-holding torsion coil spring engaging with a part of the latch mechanism and biasing the latch mechanism towards a side at which the latch mechanism latches the door; and the support shaft portion reinforcing rib formed at a protruding portion support wall of the support body, the protruding portion support wall connecting the lever rotation support shaft portion and the surrounding wall with each other.

9. The door lock device according to claim 8, comprising:

a sloped outer circumferential surface formed at the lever rotation support shaft portion and including a draft angle; and a coil contact protrusion protrudingly formed at a portion of a circumferential direction of the sloped outer circumferential surface, the portion being in contact with the coil portion, the coil contact protrusion including a ridge line which is parallel to an axial direction of the lever rotation support shaft portion.

10. The door lock device according to claim 9, comprising:

a component support auxiliary wall provided at the support body and opposing the component support wall;

the lever rotation support shaft portion where a distal end portion of a support protruding portion protrudingly formed at the component support wall is fitted into a support cylinder portion protrudingly formed at the component support auxiliary wall;

an annular protrusion protrudingly formed at the component support auxiliary wall and surrounding the entire support cylinder portion from a lateral side; and the handle interlock lever including the through hole into which the support cylinder portion is inserted, an opening edge of the through hole being applied to the annular protrusion.

11. The door lock device according to claim 10, comprising:

an auxiliary wall reinforcing rib protrudingly formed at the component support auxiliary wall to be lower than the annular protrusion and extended radially from the annular protrusion.

12. The door lock device according to claim 9, comprising:

a component support auxiliary wall provided at the support body and opposing the component support wall;

the lever rotation support shaft portion where a distal end portion of a support protruding portion protrudingly formed at the component support wall is fitted into a support cylinder portion protrudingly formed at the component support auxiliary wall; and a distal end sloped surface formed at a distal end of the support cylinder portion and obliquely intersecting a central axis of the support cylinder portion.

* * * * *